US011555281B2

(12) United States Patent
Dinitz et al.

(10) Patent No.: US 11,555,281 B2
(45) Date of Patent: Jan. 17, 2023

(54) BREAK-AWAY COUPLING FOR HIGHWAY OR ROADSIDE APPURTENANCES WITH ENHANCED FATIGUE PROPERTIES

(71) Applicant: Transpo Industries, Inc., New Rochelle, NY (US)

(72) Inventors: Arthur M. Dinitz, Westport, CT (US); Michael S. Stenko, Ridgefield, CT (US); Mahmoud Reda Taha, Albuquerque, NM (US)

(73) Assignee: TRANSPO INDUSTRIES, INC., New Rochelle, NY (US)

( * ) Notice: Subject to any disclaimer, the term of this patent is extended or adjusted under 35 U.S.C. 154(b) by 975 days.

(21) Appl. No.: 14/838,803

(22) Filed: Aug. 28, 2015

(65) Prior Publication Data

US 2016/0024729 A1 Jan. 28, 2016

Related U.S. Application Data

(63) Continuation-in-part of application No. 13/454,267, filed on Apr. 24, 2012, now abandoned.

(51) Int. Cl.
*F16M 11/00* (2006.01)
*E01F 9/635* (2016.01)

(52) U.S. Cl.
CPC ..... *E01F 9/635* (2016.02)

(58) Field of Classification Search
CPC ..... E01F 9/681; E01F 9/639
See application file for complete search history.

(56) References Cited

U.S. PATENT DOCUMENTS

| | | | | |
|---|---|---|---|---|
| 3,570,376 | A | 3/1971 | Overton, III et al. | |
| 3,606,222 | A | 9/1971 | Howard | |
| 3,637,244 | A | 1/1972 | Strizki | |
| 3,755,977 | A | 9/1973 | Lewis | |
| 3,837,752 | A | 9/1974 | Shewchuk | |
| 3,951,556 | A | 4/1976 | Strizki | |
| 3,967,906 | A | 7/1976 | Strizki | |
| 5,474,408 | A | 12/1995 | Dinitz et al. | |
| 6,056,471 | A * | 5/2000 | Dinitz | E01F 9/681 403/2 |
| 7,228,935 | B2 * | 6/2007 | Schlessmann | F01N 3/2885 173/DIG. 2 |

* cited by examiner

*Primary Examiner* — Amy J. Sterling
(74) *Attorney, Agent, or Firm* — Nolte Lackenback Siegel; Myron Greenspan

(57) ABSTRACT

A break-away coupling is formed of metal and has a central axis and a necked-down central region formed by two inverted truncated cones each having larger and smaller bases. The cones are joined at the smaller bases by a narrowed transition region having an exterior surface formed by a curved surface of revolution having an inflection point of minimum diameter substantially midway of the coupling along the axis. The cones each define an angle $\theta_1$ and $\theta_2$, respectively, at each of the larger bases, wherein both $\theta_1$ and $\theta_2$ are selected to be within the range of 20°-40° and, preferably within the range of 30°-37°.

20 Claims, 28 Drawing Sheets

$\theta = 20°$ $\theta = 30°$ $\theta = 40°$ $\theta = 20°$ $\theta = 30°$ $\theta = 40°$ $\theta = 20°$ $\theta = 30°$ $\theta = 40°$ $\theta = 32°$ $\theta = 38°$ $\theta = 45°$ $\theta = 32°$ $\theta = 38°$ $\theta = 45°$ $\theta = 32°$ $\theta = 38°$ $\theta = 45°$ $\theta = 32°$ $\theta = 38°$ $\theta = 45°$ Figure 13(a)
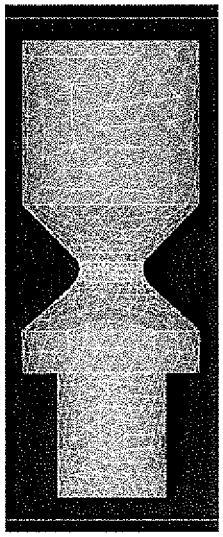
Case 1 $\theta_1 = 45° \& \theta_2 = 45°$
Figure 13(b)
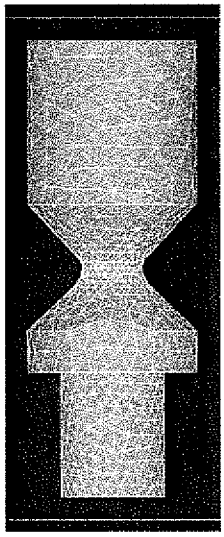
Case 2 $\theta_1 = 45° \& \theta_2 = 42°$
Figure 13(c)
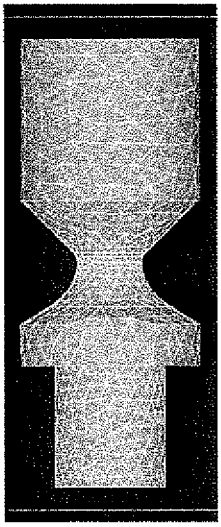
Case 3 $\theta_1 = 45° \& \theta_2 = 32°$
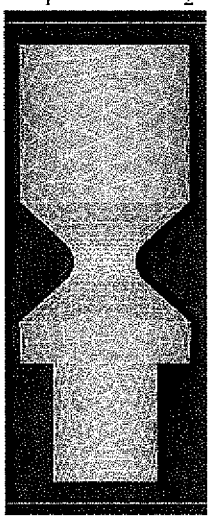
Case 4 $\theta_1 = 42° \& \theta_2 = 42°$
Figure 13(d)
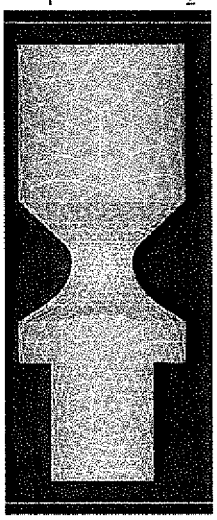
Case 5 $\theta_1 = 42° \& \theta_2 = 32°$
Figure 13(e)
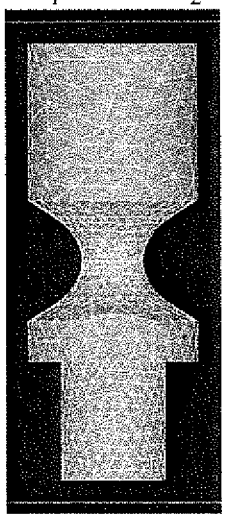
Case 6 $\theta_1 = 32° \& \theta_2 = 32°$
Figure 13(f)

Elliptic torus (a/b=1.0)

Hyperboloid (c/d=3.0)

Catenoid

Elliptic torus (a/b=1.0)

Hyperboloid (c/d=3.0)

Catenoid

Elliptic torus (a/b=1.0)

Hyperboloid (c/d=3.0)

Catenoid

Elliptic torus (a/b=1.0)

Hyperboloid (c/d=3.0)

Catenoid

Elliptic torus

Hyperboloid

Catenoid

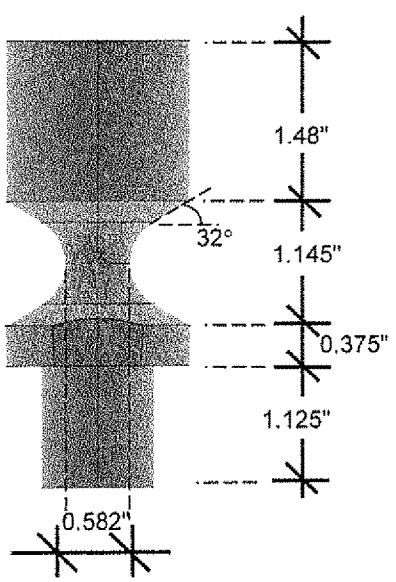
Figure 21(d)
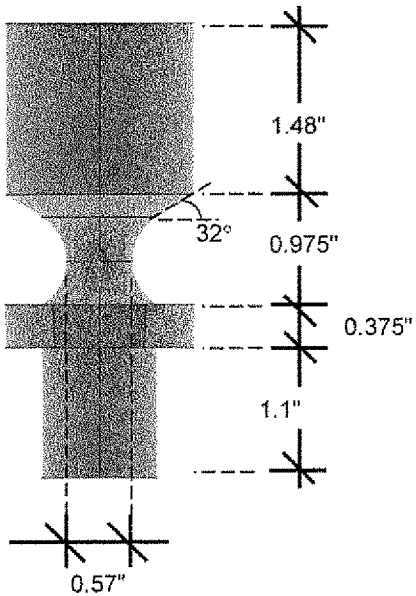
Figure 21(f)
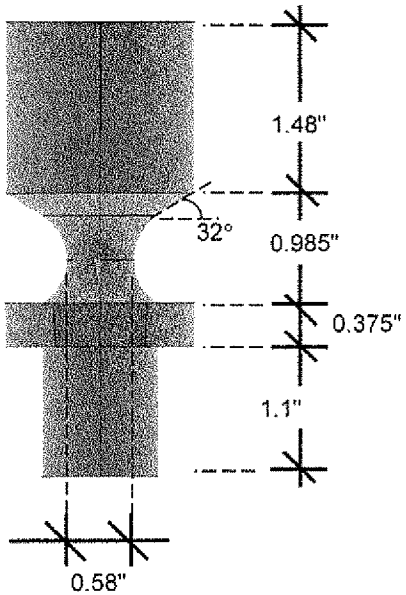
Figure 21(h)
Figure 21(e)
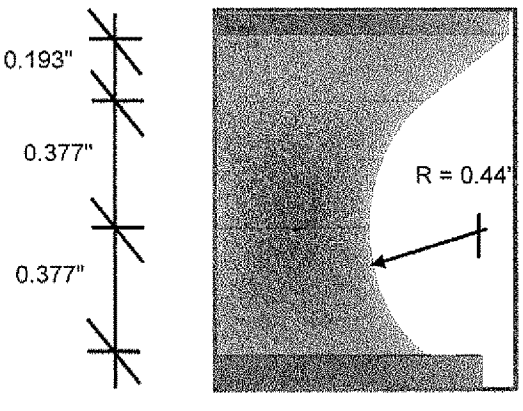
Figure 21(g)
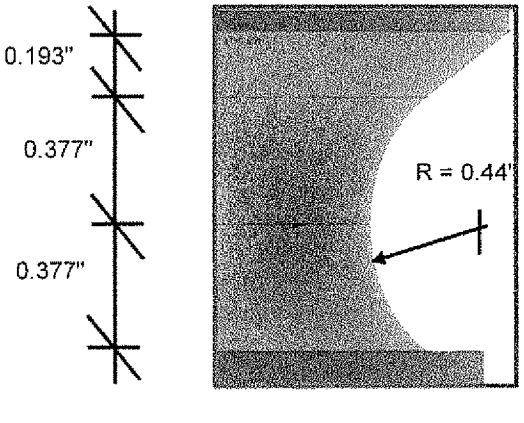
Figure 21(i)

BREAK-AWAY COUPLING FOR HIGHWAY OR ROADSIDE APPURTENANCES WITH ENHANCED FATIGUE PROPERTIES

BACKGROUND OF THE INVENTION

1. Field of the Invention

The present invention generally relates to break-away couplings for lighting poles or appurtenances mounted along highways and roadways and, more specifically, to such a break-away coupling with enhanced fatigue properties.

2. Description of the Prior Art

Many highway and roadside appurtenances, such as lighting poles, signs, etc., are mounted along highways and roads. Typically, these are mounted on and supported by concrete foundations, bases or footings. However, while it is important to securely mount such roadside appurtenances to withstand weight, wind, snow and other types of service loads, they do create a hazard for vehicular traffic. When a vehicle collides with such a light pole or sign post, for example, a substantial amount of energy is normally absorbed by the light pole or post as well as by the impacting vehicle unless the pole or post is mounted to fail at the base. Unless the post is deflected or severed from the base, therefore, the vehicle may be brought to a sudden stop with potentially fatal or substantial injury to the passengers. For this reason, highway authorities almost universally specify that light poles and the like must be mounted in such a way that they must fail at the support structure upon impact by a vehicle.

In designs of such break-away couplings several facts or considerations come into play. The couplings must have maximum tensile strength with predetermined (controlled) resistance to lateral impact load. Additionally, the couplings must be easy and inexpensive to install and maintain. They must, of course, be totally reliable.

Numerous break-away systems have been proposed for reducing damage to a vehicle and its occupants upon impact. For example, load concentrated break-away couplings are disclosed in U.S. Pat. Nos. 3,637,244, 3,951,556 and 3,967,906 in which load concentrating elements eccentric to the axis of the fasteners, for attaching the couplings to the system oppose the bending of the couplings under normal loads while presenting less resistance to bending of the coupling under impact or other forces applied near the base of the post. In U.S. Pat. Nos. 3,570,376 and 3,606,222, structures are disclosed which include a series of frangible areas. In both cases, the frangible areas are provided about substantially cylindrical structures. Accordingly, while the supports may break along the frangible lines, they do not minimize forces for bending of the posts and, therefore, generally require higher bending energies, to the possible determent of the motor vehicle.

In U.S. Pat. No. 3,755,977, a frangible lighting pole is disclosed which is in a form of a frangible coupling provided with a pair of annular shoulders that are axially spaced from each other. In a sense, the annular shoulders are in the form of internal grooves. A tubular section is provided which is designed to break in response to a lateral impact force of an automobile. The circumferential grooves are provided along a surface of a cylindrical member.

A coupling for a break-away pole is described in U.S. Pat. No. 3,837,752 which seeks to reduce maximum resistance of a coupling to bending fracture by introducing circumferential grooves on the exterior surface of the coupling. The distance from the groove to the coupling extremity is described as being approximately equal to or slightly less than the inserted length of a bolt or a stud that is introduced into the coupling to secure the coupling, at the upper ends, to a base plate that supports the post and to the foundation base or footing on which the post is mounted. The grooves are provided to serve as a stress concentrators for inducing bending fracture and to permit maximum effective length of moment arm and, therefore, maximum bending movement. According to the patent, the diameter of the neck is not the variable to manipulate in order to achieve the desired strength of the part, as the axial (tensile/compressive) strength is also affected.

However, the above mentioned couplings have shown signs of limited fatigue strength and, therefore, premature failure. Fatigue strength is a property of break-away couplings that has not always been addressed by the industry, partly because of the complex nature of the problem and its solution.

U.S. Pat. No. 5,474,408, assigned to Transpo Industries, Inc., the assignee of the present invention, discloses a break-away coupling with spaced weakened sections (Alternative Coupler). The controlled break in region included two axially spaced necked-down portions of smaller diameter and solid cross section. The dimensions of the coupling were selected so the ratio D/L is within the range V/L<=0.3 where L is the axial control breaking region and the necked-portion has a diameter D. The necked-portions have conical type surfaces to assure that at least one of the necked-portions break upon bending prior to contact between any surfaces forming or defining the necked-portions.

A multiple necked-down break-away coupling has been disclosed in U.S. Pat. No. 6,056,471 assigned to Transpo Industries, Inc., in which a control breaking region is provided with at least two axial spaced necked-portions coaxially arranged between the axial ends of the coupling (alternative coupler). Each necked-portion essentially consists of two axially aligned conical portions inverted one in the relation to the other and generally joined at their apices to form a generally hour-glass configuration having a region of a minimum cross section at an inflection point having a gradually curved concave surface defining a radius of curvature. Each of the necked-down portions have different radii of curvature that are at respective inflection points to provide preferred failure modes as a function of a position in direction of the impact of a force.

The prior patented steel couplings will be referred to as "Existing" for the one Transpo Industries has used in the field for the last 30 years and "Alternative" for the more recently developed coupling. However, these "Existing" and "Alternative" couplings have shown signs of limited fatigue strength. Therefore, a new coupling design was sought that would show marked improvements in fatigue strength.

SUMMARY OF THE INVENTION

It is, accordingly, an object of the present invention to provide a fatigue-enhanced break-away coupling for a highway or roadway appurtenance which does not have the disadvantages inherent in comparable prior art break-away couplings.

It is another object of the present invention to provide a fatigue enhanced break-away coupling which is simple in construction and economical to manufacture. It is still another object of the present invention to provide a break-away coupling of the type under discussion that is simple to install and requires minimal effort and time to install in the field.

It is yet another object of the present invention to provide a fatigue-enhanced break-away coupling as in the aforementioned objects which is simple in construction and reliable, and whose functionality is highly predictable.

It is yet another object of the present invention to provide a fatigue-enhanced break-away coupling as in the previous objects which can be retrofitted to most existing break-away coupling systems.

It is still a further object of the present invention to provide a fatigue-enhanced break-away coupling that minimize forces required to fracture the coupling in bending while maintaining safe levels of tensile and compressive strength to withstand non-impact forces, such as wind load.

It is yet a further object of the present invention to provide fatigue-enhanced break-away couplings of the type suggested in the previous objects which essentially consists of one part and, therefore, requires minimal assembly in the field and handling of parts.

It is an additional object of the present invention to provide a break-away coupling as in the above objects geometrically optimized to enhance the fatigue properties of the coupling.

In order to achieve the above and additional objects a break-away coupling in accordance with the invention is formed of metal and has a central axis and a necked-down central region formed by two inverted truncated cones each having larger and smaller bases. The cones are joined at the smaller bases by a narrowed transition region having an exterior surface formed by a curved surface of revolution having an inflection point of minimum diameter substantially midway of the coupling along said axis, said cones each defining an angle $\theta_1$ and $\theta_2$, respectively, at each of said larger bases, wherein both $\theta_1$ and $\theta_2$ are selected to be less than 40°, such as within the range of 20°-40°, and, preferably, within the range of 30°-37°.

BRIEF DESCRIPTION OF THE DRAWINGS

Those skilled in the art will appreciate the improvements and advantages that derive from the present invention upon reading the following detailed description, claims, and drawings, in which:

FIG. 13(*a*)-13(*f*) are snapshots of finite element models for unequal double cone couplers with an elliptic torus surface of revolution and different combinations of base angles;

FIG. 21(*d*) is a rendering of an EF coupler in accordance with the invention having two base angles equal to 32°;

FIG. 21(*e*) is a fragmented enlarged view of the neck portion of the coupler shown in FIG. 21(*d*);

FIG. 21(*f*) is similar to FIG. 21(*d*) for a modified EF coupler-Mod-A;

FIG. 21(*g*) is similar to FIG. 21(*e*) for the Mod-A coupler shown in FIG. 21(*f*);

FIG. 21(*h*) is similar to FIG. 21(*f*) but for a modified EF coupler-Mod-B;

FIG. 21(*i*) is similar to FIGS. 21(*e*) and 21(*g*) for the Mod-B coupler shown in FIG. 21(*h*);

DETAILED DESCRIPTION

Introduction

Transpo Industries Inc. has designed and patented two steel couplers in 1985 and 2000. The 1985 Coupler is described in U.S. Pat. No. 4,528,786 and will be referred to as the "Existing" coupler that Transpo Industries has used in the field for the last 30 years. The 2000 coupler is described in U.S. Pat. No. 6,056,471 and will be referred to as "Alternative" for the more recently developed coupler. However, these couplers were designed for enhanced mechanical performance but not specifically for fatigue properties. This application describes a geometry for couplers to enhance their fatigue performance over previous couplers. The geometrical design process recognizes a geometrical design range "interval" where the fatigue performance of couplers is expected to significantly exceed that of the "Existing" and the "Alternative" couplers.

The objective of this work was to design a coupler geometry that significantly increases the fatigue strength of existing couplers. Couplers designed in accordance with the present invention that improve fatigue strength properties will be designated herein as "enhanced fatigue" couplers or "EF" couplers. The process aims to reduce the stress gradients within the necking region. These stress gradients are believed to control the fatigue life of the couplers. High stress gradients result in premature fatigue failure under cyclic loads.

Figure 1:
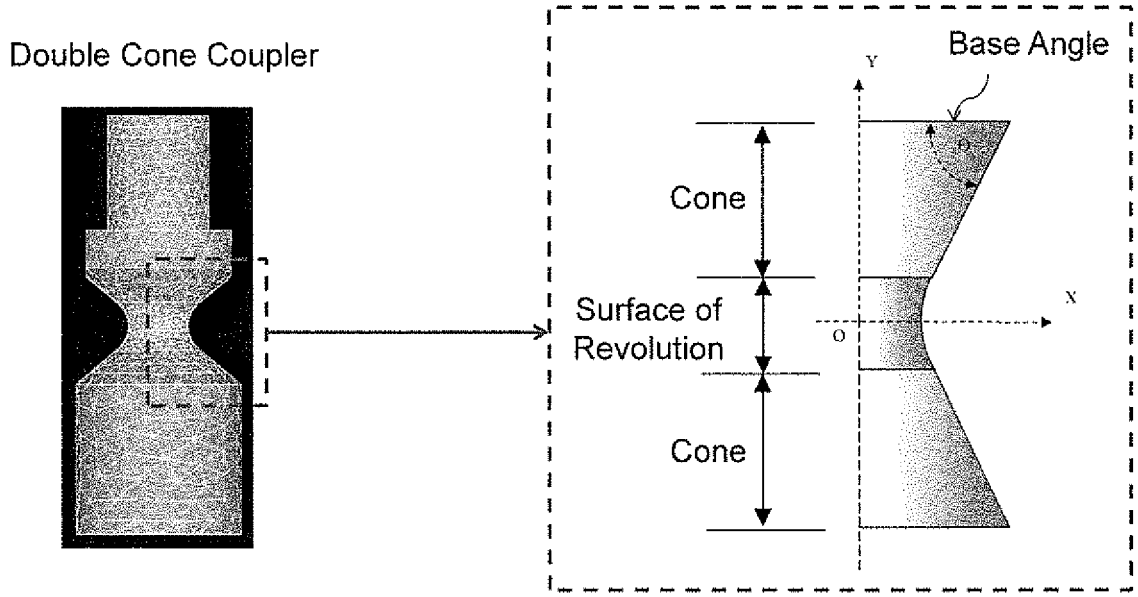
FIG. 1 illustrates a typical geometry of a necking region of a double cone coupler and the component pails thereof.

The typical geometry for the necking region of a double cone coupler consists of two cones and a surface of revolution as shown in FIG. 1.

In particular, the objective of the design process was to:

1—Determine the significance and select the type of surface of revolution of the necking region. Three types of surfaces of revolution were examined. The three types are elliptic torus, hyperboloid, and catenoid. Different surfaces of revolution yielded different curvature profiles through the depth of the necking region which in turn affected the stress gradients in the necking region.

2—Identify the effect and value(s) of geometric designs including different base angles $\theta_1$, $\theta_2$. It is explained below how all the other design variables (dimensions) are based on the base angles $\theta$ given the problem constraints to keep the base diameter, the neck diameter and the coupler height constant to satisfy other critical requirements of the couplers.

3—Examine the significance of using unequal base angles $\theta_1$, $\theta_2$ on the stress gradients in the necking region. This included developing two sets of design variables (dimensions) for the two halves of the necking region. In this study, elliptic torus surface of revolution is selected as a case study for creating the surface of revolution. However, similar findings could be observed for all surfaces of revolution with unequal base angles.

Geometrical Considerations

Several geometric variables were defined for the design effort. These variables include the base angle ($\theta$), the constants of the surface curvature, the depth of the cone ($h_1$), and half the depth of the surface of revolution ($h_2$). Assuming that the origin is located at the mid height and width of the necking region, there are three other characteristic points that determines the geometry of the necking region. These are A, B, and D. Geometrical relationships were developed for each type of surface of revolution as discussed in this section. To develop these relationships, three geometrical constraints were imposed to all necking region geometries. These constraints are described below.

1) The first constraint implies that the necking diameter remains constant (0.582") to maintain the same shear design capacity of the couplers. Therefore, the coordinates of point A is set as (0.291",0).
2) The diameter of the base is also maintained constant of 1.625". This is necessary to keep the diameter of the coupler unchanged. Therefore, the coordinates of point D is (0.812", 0.57").
3) The depth of the necking region is maintained 0.572" as described by Eqn. (1). In addition, Eqn. (2) describes the limitation for minimum practical depths of $h_1$ and $h_2$.

$$h_1+h_2=0.57'' \tag{1}$$

$$h_1 \text{ and } h_2 \leq 0.05'' \tag{2}$$

4) The surface of the cone is maintained tangent to the surface of revolution at point B. This constraint guarantees smooth transition for the stresses between the cone and the surface of revolution. Based on the geometrical constraints, the geometrical relationships were developed for each surface of revolution. The case of equal base angles is covered in subsections (a), (b), and (c) while the case of unequal base angles is covered in subsection (d).

(a) Equal Elliptic Torus

Figure 2:
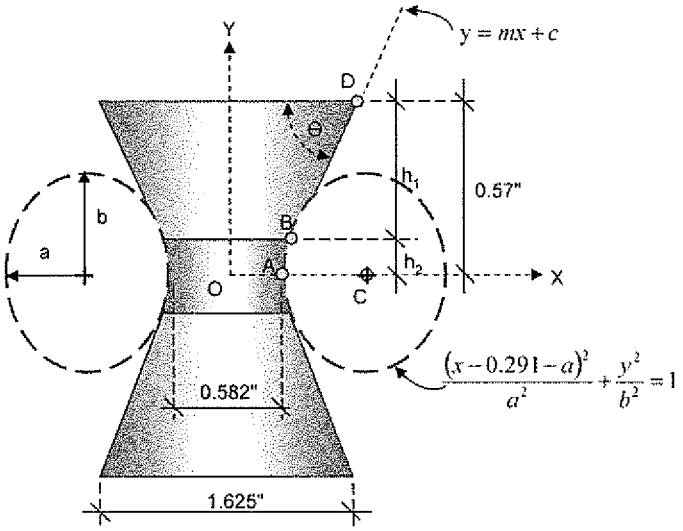
FIG. 2 is a schematic of a necking region with an elliptic torus surface of revolution.

The development of the surface of the necking region was obtained by rotating a tangent line and elliptic torus 360° about the couplers longitudinal axis as shown in FIG. 2. The elliptic torus is characterized by its horizontal and vertical axes (a and b) and its center location at point C (0.291+a,0). Three horizontal-to-vertical axes ratios (a/b) are examined in the optimization process; 0.65, 1.0, and 1.5. The following set of equations is developed for the geometrical relationships of the necking region based on the geometrical constrains and the elliptic torus characteristics.

Definition of horizontal-to-vertical axes ratio $$a/b=0.65, \text{ or } 1.5 \tag{3}$$

Base angle is the slope of the tangent $$m=\tan\theta \tag{4}$$

Total depth of necking region is 0.57"

$$h_1+h_2=0.57'' \tag{5}$$

Points B ($x_B$, $h_2$) and Point D (0.812,0.57) satisfies the tangent equation $$y_D=m\cdot x_D+c \tag{6}$$

$$y_B=m\cdot x_B+c \tag{7}$$

Points B ($x_B$, $h_2$) satisfies the elliptic torus equation $$\frac{(x_B-0.291-a)^2}{a^2}+\frac{(y_B)^2}{b^2}=1 \tag{8}$$

Tangency condition at point B.

$$\text{Discriminant of}\left[\frac{(x-0.291-a)^2}{a^2}+\frac{(m\cdot x+c)^2}{b^2}=1\right]=0 \tag{9}$$

Figure 3A:
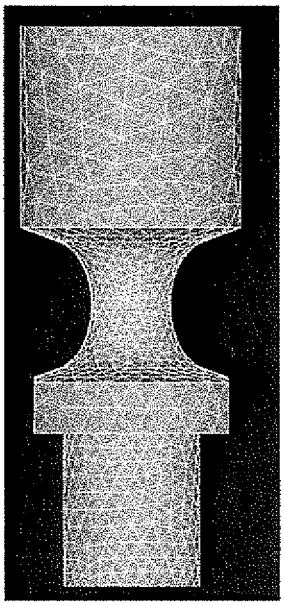
FIGS. 3(*a*)-3(*c*) are snapshots of finite element models of double cone couplers with an elliptic torus (a/b=0.65) surface of revolution and three different base angles.
Figure 3B:
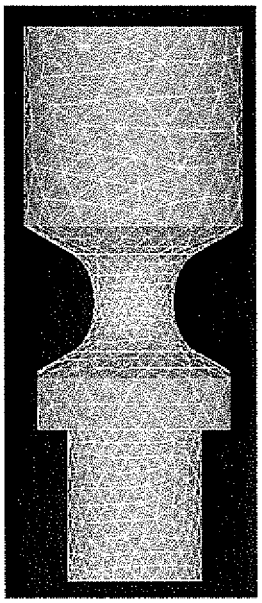
Figure 3C:
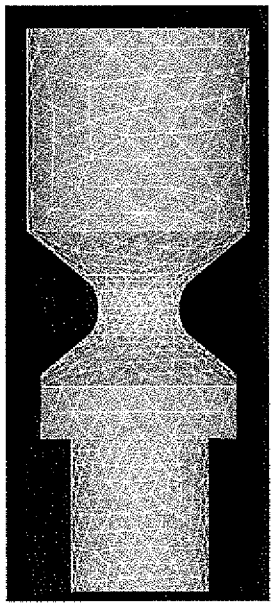

The geometry of the necking region of the coupler was obtained by solving the aforementioned seven simultaneous equations (Eqns 3 to 9) to find the seven geometrical parameters (a,b,c,$x_B$,$h_1$,$h_2$,m). Table (1) to (3) show the calculated geometrical parameters for some base angles with different a/b ratios while FIGS. 3(*a*)-5(*c*) show the corresponding snapshots of the EF models.

TABLE (1)

Geometrical parameters for necking region with elliptical torus (a/b = 0.65)

| Base angle θ, degree | Cone depth ($h_1$), inch | Elliptic torus depth ($h_2$), inch | Horizontal axis (a), inch | Vertical axes (b), inch |
|---|---|---|---|---|
| 20 | 0.102 | 0.468 | 0.312 | 0.481 |
| 30 | 0.206 | 0.364 | 0.252 | 0.388 |
| 40 | 0.373 | 0.196 | 0.145 | 0.224 |

TABLE (2)

Geometrical parameters for necking region with elliptic torus (a/b = 1.0)

| Base angle θ, degree | Cone depth ($h_1$), inch | Elliptic torus depth ($h_2$), inch | Horizontal axis (a), inch | Vertical axes (b), inch |
|---|---|---|---|---|
| 20 | 0.058 | 0.513 | 0.546 | 0.546 |
| 30 | 0.165 | 0.406 | 0.469 | 0.469 |
| 40 | 0.350 | 0.221 | 0.289 | 0.289 |

TABLE (3)

Geometrical parameters for necking region with elliptic torus (a/b = 1.5)

| Base angle θ, degree | Cone depth ($h_1$), inch | Elliptic torus depth ($h_2$), inch | Horizontal axis (a), inch | Vertical axes (b), inch |
|---|---|---|---|---|
| 20 | 0.0073 | 0.562 | 0.961 | 0.641 |
| 30 | 0.124 | 0.445 | 0.883 | 0.589 |
| 40 | 0.333 | 0.237 | 0.571 | 0.381 |

(b) Equal Hyperboloid

Figure 6:
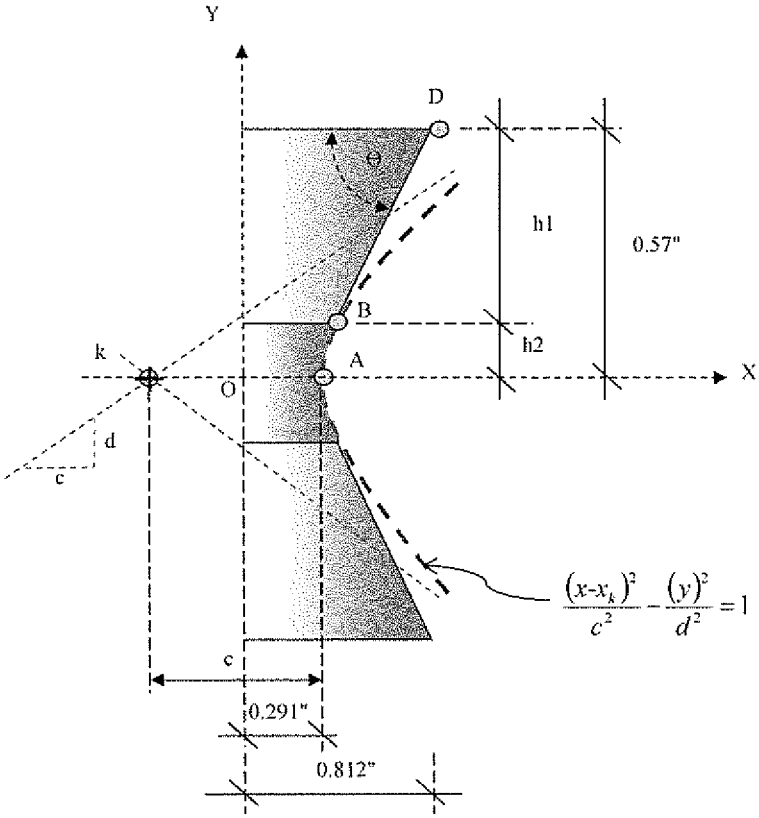
FIG. 6 is a schematic of a necking region with a hyperboloid surface of revolution.

The development of the surface of the necking region was obtained by rotating a tangent line and a hyperbola 360° about the coupler's longitudinal axis as shown in FIG. 6. The hyperbola is characterized by its horizontal and vertical semi-axes (c and d) and its symmetric axis location passing through point k ($x_k$,0). Three horizontal-to-vertical semi-axes ratios (c/d) are examined in the optimization process; 3, 4, and 5. The following set of equations is developed for the geometrical relationships of the necking region based on the geometrical constrains and the hyperbola characteristics.

Definition of horizontal-to-vertical semi-axes ratio $$c/d=3,4 \text{ or } 5 \tag{10}$$

Base angle is the slope of the tangent $$m=\tan\theta \tag{11}$$

Total depth of necking region is 0.57"

$$h_1+h_2=0.57'' \tag{12}$$

Points B ($x_B$, $h_2$) and D (0.812,0.57) satisfies the tangent equation $$y_D=m\cdot x_D+n \tag{13}$$

$$y_B=m\cdot x_B+n \tag{14}$$

Points B ($x_B$, $h_2$) satisfies the elliptic torus equation $$\frac{(x_B-x_k)^2}{c^2}-\frac{(y_B)^2}{d^2}=1 \tag{15}$$

Center of Symmetry of hyperbola point k ($x_k$,0)

$$x_k+c=0.291 \tag{16}$$

Tangency condition at point B.

$$\text{Discriminant of}\left[\frac{(x-x_k)^2}{c^2}+\frac{(m\cdot x+n)^2}{d^2}=1\right]=0 \tag{17}$$

Figure 7A:
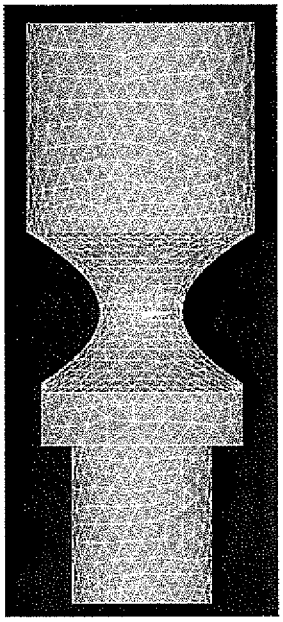
FIGS. 7(*a*)-7(*c*) are snapshots of finite element models of double cone couplers with a hyperboloid (c/d=3) surface of revolution and three different base angles.
Figure 7B:
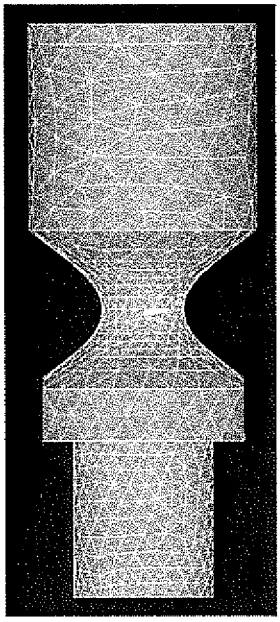
Figure 7C:
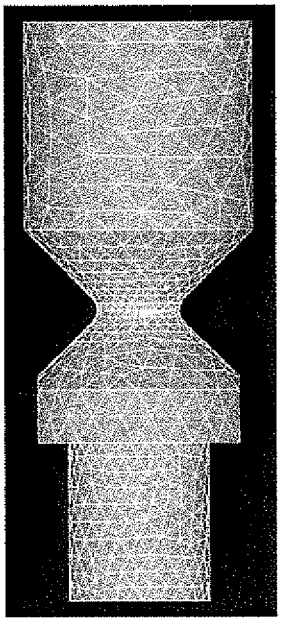
Figure 8A:
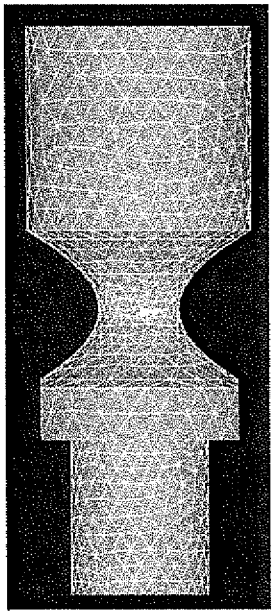
FIGS. 8(*a*)-8(*c*) are snapshots of finite element models of double cone couplers with a hyperboloid (c/d=4) surface of revolution and three different base angles.
Figure 8B:
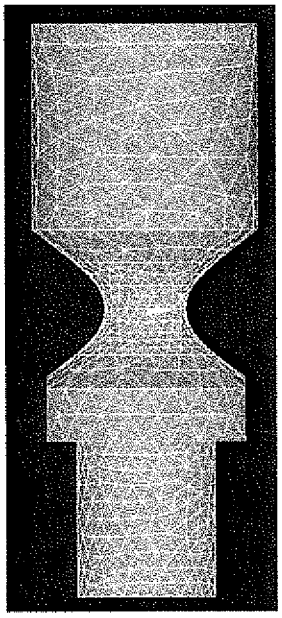
Figure 8C:
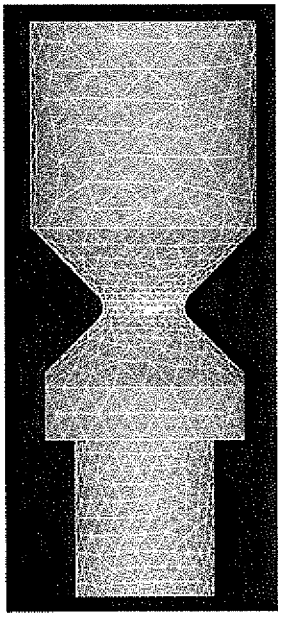
Figure 9A:
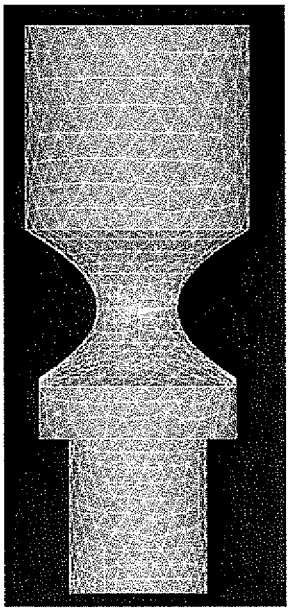
FIGS. 9(*a*)-9(*c*) are snapshots of finite element models of double cone couplers with a hyperboloid (c/d=5) surface of revolution and three different base angles.
Figure 9B:
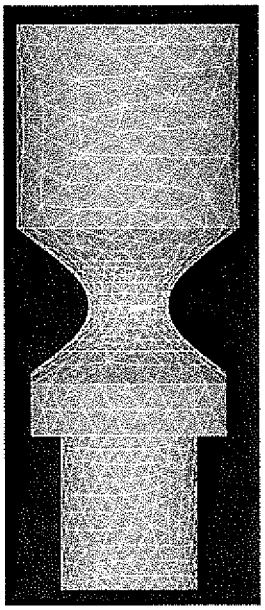
Figure 9C:
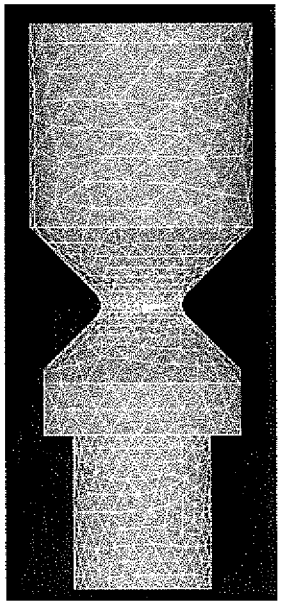

The geometry of the necking region of the coupler was obtained by solving the aforementioned eight simultaneous equations (Eqns 10 to 17) to find the eight geometrical parameters (c,d,n,$x_B$,$h_1$,$h_2$,$x_k$). Table (4) to (6) show the calculated geometrical parameters for some base angles with different c/d ratios while FIGS. 7 to 9 show the corresponding snapshots of the EF models.

TABLE (4)

Geometrical parameters for necking region with hyperboloid (c/d = 3)

| Base angle θ, degree | Cone depth ($h_1$), inch | Hyperboloid depth ($h_2$), inch | Horizontal semi axis (c), inch | Vertical semi axes (d), inch |
|---|---|---|---|---|
| 32 | 0.036 | 0.533 | 2.537 | 0.845 |
| 38 | 0.226 | 0.343 | 2.182 | 0.727 |
| 45 | 0.469 | 0.101 | 0.856 | 0.285 |

TABLE (5)

Geometrical parameters for necking region with hyperboloid (c/d = 4)

| Base angle θ, degree | Cone depth ($h_1$), inch | Hyperboloid depth ($h_2$), inch | Horizontal semi axis (c), inch | Vertical semi axes (d), inch |
|---|---|---|---|---|
| 32 | 0.058 | 0.511 | 4.683 | 1.170 |
| 38 | 0.235 | 0.334 | 3.966 | 0.991 |
| 45 | 0.470 | 0.099 | 1.543 | 0.3857 |

TABLE (6)

Geometrical parameters for necking region with hyperboloid (c/d = 5)

| Base angle θ, degree | Cone depth ($h_1$), inch | hyperboloid depth ($h_2$), inch | Horizontal semi axis (c), inch | Vertical semi axes (d), inch |
|---|---|---|---|---|
| 32 | 0.067 | 0.502 | 7.436 | 1.487 |
| 38 | 0.238 | 0.331 | 6.259 | 1.251 |
| 45 | 0.470 | 0.099 | 2.425 | 0.485 |

(c) Equal Catenoid

Figure 10:
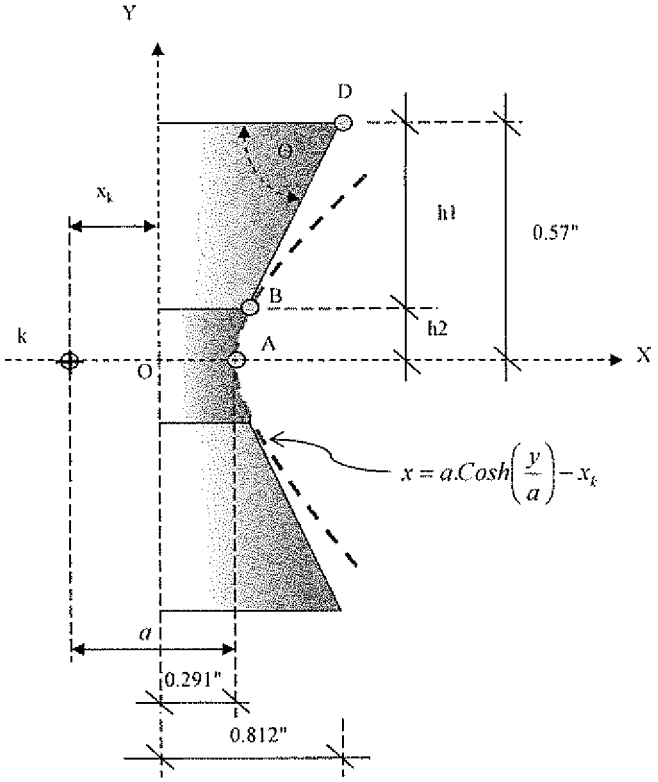
FIG. 10 is a schematic of a necking region with a catenoid surface of revolution.

The development of the surface of the necking region was obtained by rotating a tangent line and a catenary curve 360° about the couplers longitudinal axis as shown in FIG. 10. The catenary curve is characterized by its scaling parameter a and its vertex location. Unlike the elliptic torus and the hyperboloid, the catenoid has only one geometrical case for each base angle. The following set of equations is developed for the geometrical relationships of the necking region based on the geometrical constrains and the catenary curve characteristics.

Base angle is the slope of the tangent $$m=\tan\theta \tag{18}$$

Total depth of necking region is 0.57"

$$h_1+h_2=0.57'' \tag{19}$$

Points B ($x_B$, $h_2$) and D (0.812,0.57) satisfies the tangent equation $$y_D=m\cdot x_D+c \tag{20}$$

$$y_B=m\cdot x_B+c \tag{21}$$

Points B ($x_B$,$h_2$) satisfies the elliptic torus equation $$x_B=a\cdot\mathrm{Cosh}\left(\frac{h_2}{a}\right)-x_k \tag{22}$$

Vertex location at point A (0.291,0) requires that.

$$a=x_k+0.291 \tag{23}$$

Tangency condition at point B.

$$\text{Discriminant of } x-a\cdot\left[1+\frac{1}{2!}\left(\frac{m\cdot x+c}{a}\right)^2\right]+x_k=0 \tag{24}$$

Figure 11A:
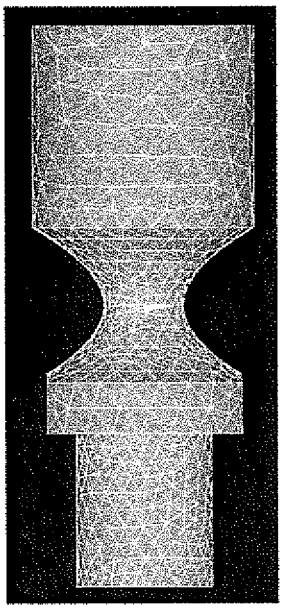
FIGS. 11(*a*)-11(*c*) are snapshots of finite element models for double cone couplers with a catenoid surface of revolution and three base angles.
Figure 11B:
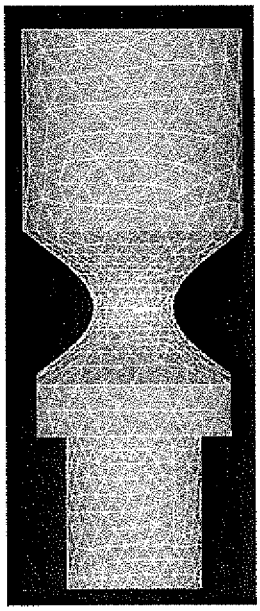
Figure 11C:
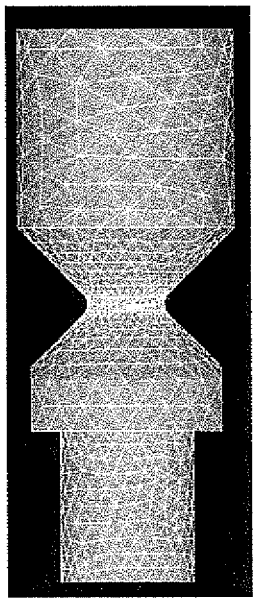

The geometry of the necking region of the coupler was obtained by solving the aforementioned eight simultaneous equations (Eqns 18 to 24) to find the eight geometrical parameters (c,a,$x_B$,$h_1$,$h_2$,m,$x_k$). Table (7) shows the calculated geometrical parameters for some base angles while FIGS. 11(*a*)-11(*c*) shows the corresponding snapshots of the EF model.

TABLE (7)

Geometrical parameters for necking region with catenoid.

| Base angle θ, degree | Cone depth ($h_1$), inch | catenoid depth ($h_2$), inch | Scaling parameter (a), inch |
|---|---|---|---|
| 32 | 0.081 | 0.488 | 0.305 |
| 38 | 0.244 | 0.325 | 0.254 |
| 45 | 0.472 | 0.098 | 0.098 |

(d) Unequal Elliptic Tori

Figure 12:
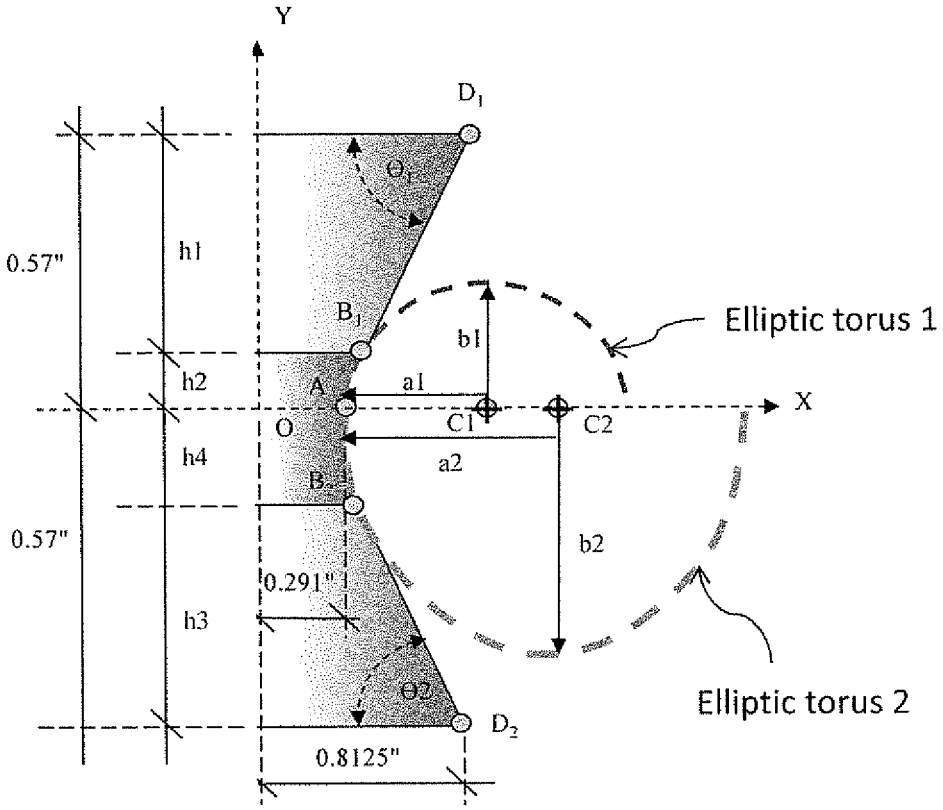
FIG. 12 is a schematic of a necking region with a elliptic torus surface of revolution and two different base angles.

This case is similar to case (a) except that there are two different lines and two different elliptic tori that are used to create the necking region. The development of the surface of the necking region in this case was obtained by rotating the two tangent lines and the two elliptic tori 360° about the couplers longitudinal axis as shown in FIG. 12. The elliptic tori are characterized by their horizontal and vertical axes ($a_1$, $b_1$ and $a_2$, $b_2$) and their centers location at point $C_1$ (0.291+$a_1$,0) and point $C_2$ (0.291+$a_1$,0). One horizontal-to-vertical axes ratio (a/b) of 1.5 is examined in the optimization process. The same set of equations (Eqns 3-9) is used for developing the geometrical relationships of each half of the necking region based on the geometrical constrains and the elliptic tori characteristics. Three different base angles are altered to develop six cases of necking regions with unequal base angles as shown in the snapshots in FIG. 13(*a*)-13(*f*). The base angles are 45°, 42°, and 32°. The three selected angles represent large, moderate, and small angles and cover the entire range of base angles. The dimensions for the six cases are also summarized in Table (8).

TABLE (8)

Geometrical parameters for necking region with unequal base angles.

| | Case 1 | Case 2 | Case 3 | Case 4 | Case 5 | Case 6 |
|---|---|---|---|---|---|---|
| First base angle $\theta_1$, degree | 45 | 45 | 45 | 42 | 42 | 32 |
| Second base angle $\theta_2$, degree | 45 | 42 | 32 | 42 | 32 | 32 |
| First cone depth ($h_1$), inch | 0.48 | 0.48 | 0.48 | 0.39 | 0.39 | 0.16 |
| First elliptical torus depth ($h_2$), inch | 0.09 | 0.09 | 0.09 | 0.18 | 0.18 | 0.41 |
| Second cone depth ($h_1$), inch | 0.48 | 0.39 | 0.16 | 0.39 | 0.16 | 0.16 |
| Second elliptical torus depth ($h_2$), inch | 0.09 | 0.18 | 0.41 | 0.18 | 0.41 | 0.41 |
| Horizontal axis for first elliptical torus ($a_1$), inch | 0.24 | 0.24 | 0.24 | 0.46 | 0.46 | 0.85 |
| Horizontal axis for second elliptical torus ($a_2$), inch | 0.16 | 0.16 | 0.16 | 0.31 | 0.31 | 0.56 |
| Vertical axis for first elliptical torus ($b_1$), inch | 0.24 | 0.46 | 0.85 | 0.46 | 0.85 | 0.85 |
| Vertical axis for second elliptical torus ($b_2$), inch | 0.16 | 0.31 | 0.5 | 0.31 | 0.56 | 0.56 |

Objective Function

The main objective is to reduce or to minimize the stress gradient within the cone and the surface of revolution. In particular, the stress gradients through the necking region need to be reduced or minimized. Two cases are considered in this investigation as discussed herein; equal base angles and unequal base angles.

(a) Equal Base Angles

Figure 14:
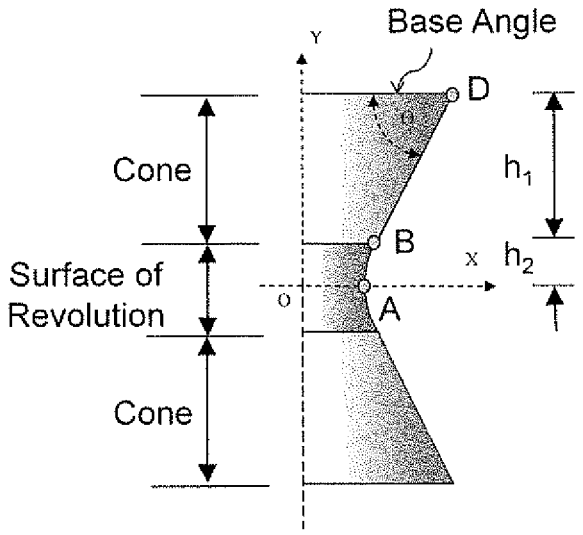
FIG. 14 is a schematic representation for a coupler geometry with equal base angles showing the location of the critical points used for computing stress gradients.

In this case it is assumed that the two base angles in the necking region are equal. This would yield symmetric necking region about X and Y axes as shown in FIG. 12. In this case the stress gradients for the top and bottom halves are similar and therefore examining only one half of the necking region is sufficient. Therefore, the stress gradient between points A & B (SG_AB) and the stress gradient between points B & D (SG_BD) as shown in in FIG. 14 is minimized. To minimize the stress gradients, the objective function F were developed and evaluated as discussed in this section. The necking geometry has one independent variable which is the base angle (θ) and other dependent variables that fully describe the coupler geometry [(a, b, $h_1$, $h_2$) for elliptic torus case; (c, d, $h_1$, $h_2$) for hyperboloid case; (a, $h_1$, $h_2$) for catenoid case]. In each iteration, the design variable (base angle) θ is assumed and the corresponding design parameters including the curvature constants, the depth of the cone $h_1$, and half the depth of the surface of revolution $h_2$ are computed.

The stress gradients between points A & B (SG_AB) and points B & D (SG_BD) were calculated based on the gradient of Von Mises stress obtained by EF simulation as described by Eqn. (25) & Eqn. (26) respectively. The objective function "F" is defined as a multi-objective function combining the two functions $f_1$ and $f_2$ from Eqn. (25) and Eqn. (26) respectively.

$$f_1 = \text{SG_AB} = \frac{von\ Mises(A) - von\ Mises(B)}{h_2} \tag{25}$$

$$f_2 = \text{SG_BD} = \frac{von\ Mises(B) - von\ Mises(D)}{h_1} \tag{26}$$

The objective function "F" is formulated as a weighted sum of the two stress gradients as described by Eqn. (27).

$$F = w_1 \cdot f_1 + w_2 \cdot f_2 \tag{27}$$

where $w_1$ is the weight of the stress gradient between A & B, $w_2$ is the weight of the stress gradient between B & D. In this study, $w_1$ and $w_2$ are chosen to be ⅔ and ⅓ respectively. The preference made for SG_AB over SG_BD because our prior observations of fatigue behavior of the couplers (Phase I and Phase II of this study) showed that failure usually occurs in the necking region (AB). The base angle(s) θ with the lowest objective function value represents optimal design(s).

(b) Unequal Base Angles

Figure 15:
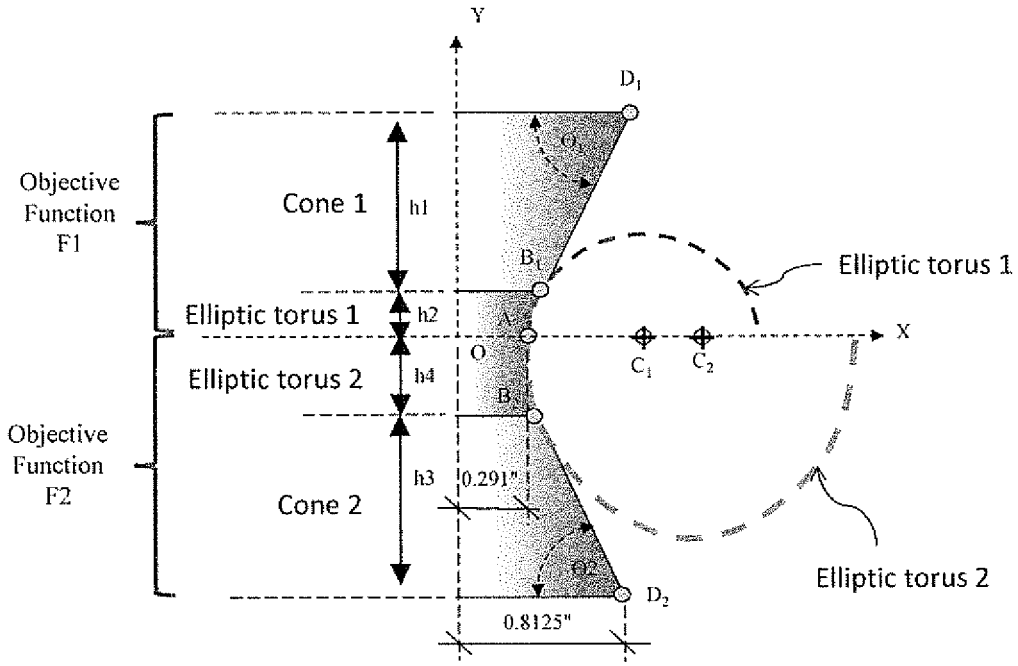
FIG. 15 is a schematic representation for a coupler geometry with unequal base angles showing the location of the critical points used for computing stress gradients.

In this case, it is assumed that the two base angles differ which would result in different dimensions between the top and bottom halves. This in turn will differ the stress gradients between the two halves. Two elliptic tori and cones were used with unequal base angles to define the surface of revolution region as shown in FIG. 15. As a result, two objective functions are developed for the two halves. Points A, $B_1$, $D_1$ are used to calculate the stress gradients for the top half $SG_AB_1$ and $SG_B_1D_1$ as shown in Eqns (28) and (29) respectively. On the other hand, points A, $B_2$, $D_2$ are used to calculate the stress gradients for the bottom half $SG_AB_2$ and $SG_B_2D_2$ as shown in Eqns (30) and (31) respectively. The objective functions $F_1$ and $F_2$ for the two halves are then calculated according to Eqns (32) and (33) respectively with same weights for stress gradients as used for the equal base angles case.

$$f_{AB1} = \text{SG_AB}_1 = \frac{von\ Mises(A) - von\ Mises(B)}{h_2} \tag{28}$$

$$f_{BD1} = \text{SG_B}_1D_1 = \frac{von\ Mises(B_1) - von\ Mises(D_1)}{h_1} \tag{29}$$

$$f_{AB2} = \text{SG_AB}_2 = \frac{von\ Mises(A) - von\ Mises(B_2)}{h_4} \tag{30}$$

$$f_{BD2} = \text{SG_B}_2D_2 = \frac{von\ Mises(B_2) - von\ Mises(D_2)}{h_2} \tag{31}$$

$$F_1 = w_1 \cdot f_{AB1} + w_2 \cdot f_{BD1} \tag{32}$$

$$F_2 = w_1 \cdot f_{AB2} + w_2 \cdot f_{BD2} \tag{33}$$

Results and Analysis

The range of base angles θ was determined for each surface of revolution so that it achieves the geometrical considerations. Based on the geometrical consideration, the elliptic torus has a base angle ranging between 20° and 46° while the hyperboloid and catenoid has a base angle ranging between 30° and 46°. It is important to note that the current design for Alternative (AL-1) couplers is based on base angle of 45°.

Figure 16A:
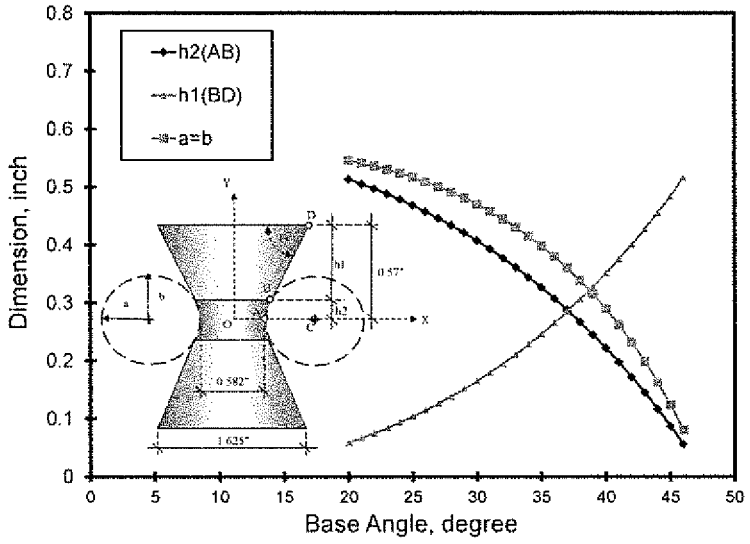
FIGS. 16(*a*)-16(*c*) illustrate the dimensions for two-cone couplers with different surfaces of revolution.
Figure 16B:
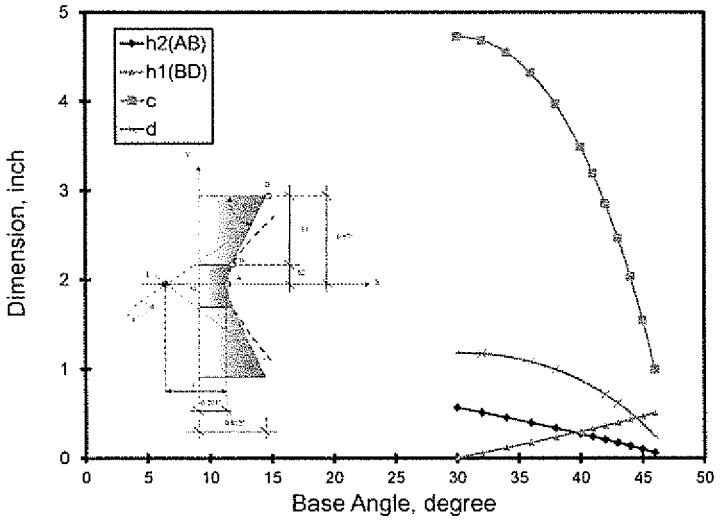
Figure 16C:
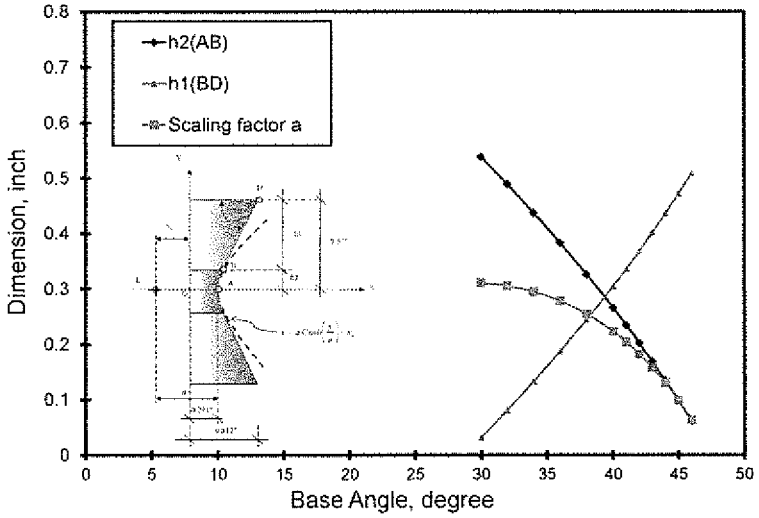

The change in couplers dimensions as a function of base angle is depicted in FIG. 16. One geometrical case for each surface of revolution is presented here. However, all other geometrical cases share similar results. For the elliptic torus, the case of a/b=1.0 is presented while for hyperboloid, the case of c/d=3.0 is presented. As expected, FIG. 16, shows that all geometric parameters changes nonlinearly with the change of base angle θ. The surface of revolution depth $h_2$ increase nonlinearly with the increase of base angle θ while the cone depth $h_1$ decreases with the increase of base angle θ. The nonlinear relationship between the base angle θ and other dimensions demonstrates the complexity in the stress state and justifies the need for multi-objective optimization in order to determine a suitable or optimal coupler geometry for improved fatigue properties.

Figure 4A:
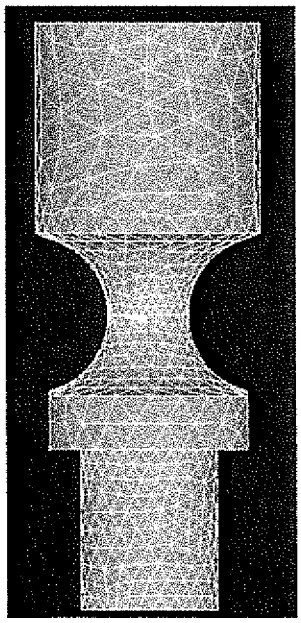
FIGS. 4(*a*)-4(*c*) are snapshots of finite element models of double cone couplers with an elliptic torus (a/b=1.0) surface of revolution and three different base angles.
Figure 4B:
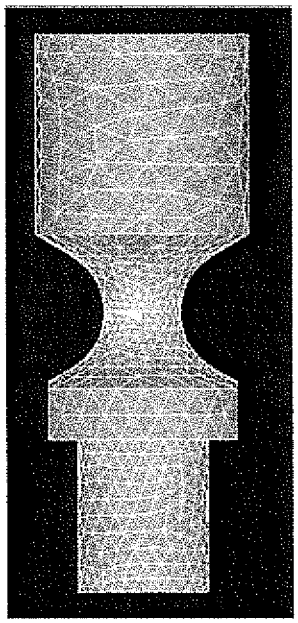
Figure 4C:
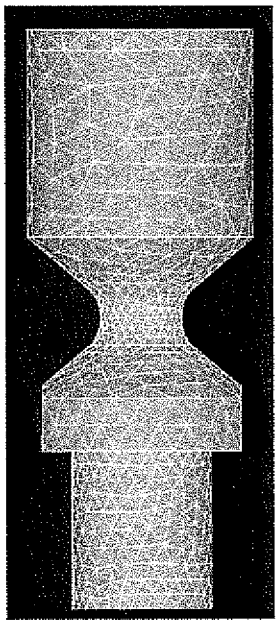
Figure 17A:
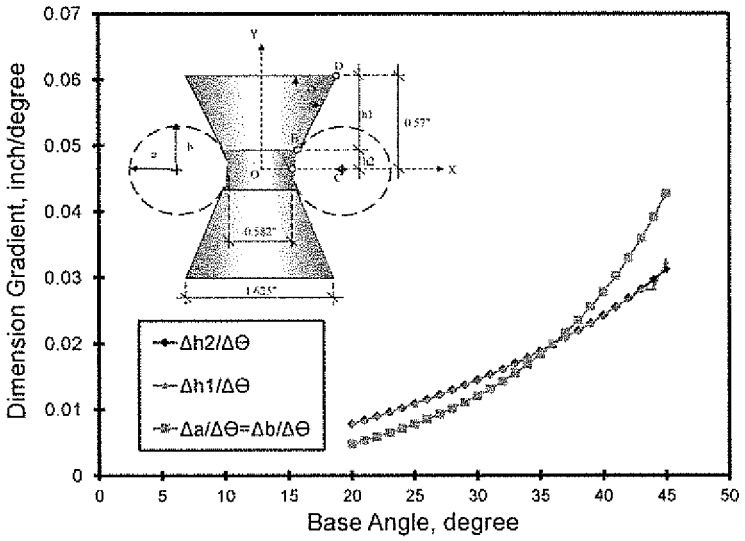
FIGS. 17(*a*)-17(*c*) illustrate the sensitivity analysis on the coupler's dimensions with different surfaces of revolution.
Figure 17B:
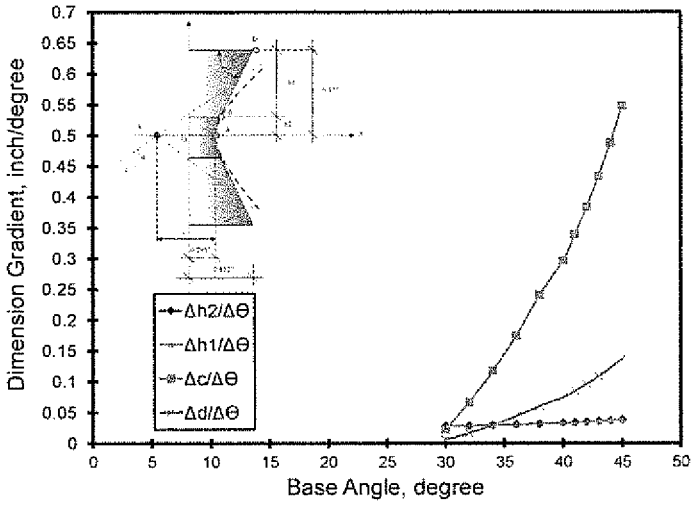
Figure 17C:
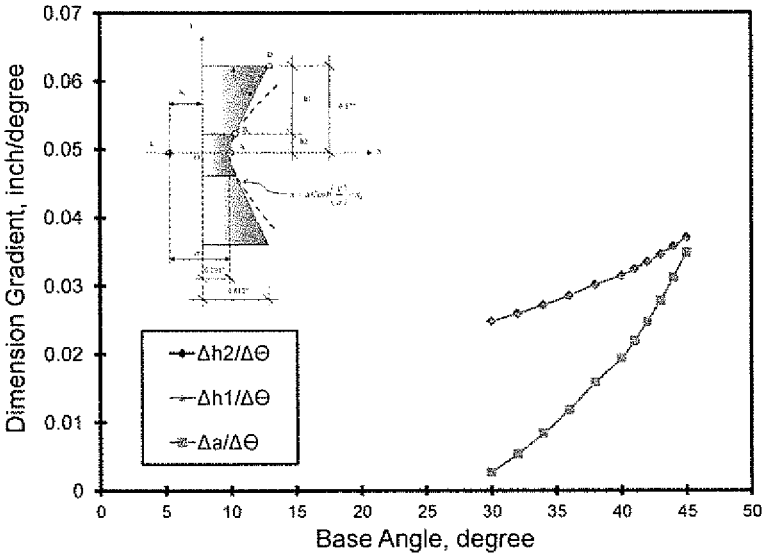

It is also observed in FIGS. 16(*a*)-16(*c*) that the change in base angle θ has a significant effect on the geometry of the coupler for relatively large base angles (>40°). As the base angle θ decreases, its effect on the coupler's geometry decreases gradually. For instance, in the snapshots for the case of elliptic torus shown in FIGS. 3-5, there is no significant difference in geometry between couplers with base angles θ of 20°-30°. On the other hand, significant change in the coupler's geometry takes place as the base angles changes θ between 30° and 40°. A sensitivity analysis was performed to provide in-depth understanding of geometrical design sensitivity to the independent variable (base angle θ). The results of this sensitivity analysis are shown in FIGS. 17(*a*)-17(*c*) where the change in the dimensions with respect to the base angle θ (dimension gradient) is plotted against the base angle. The figure shows that at relatively high base angles (>40°) the change in dimensions is very sensitive to changes in the base angle. In design, it is recommended to have design geometry within a region of relatively low sensitivity in dimension gradient. This would reduce the statistical variation of the mechanical response of the coupler due to relatively small variations in geometry during production. The analysis performed here proves that the current design (AL-1) falls within a region of very high geometrical sensitivity which is not good.

Figure 18A:
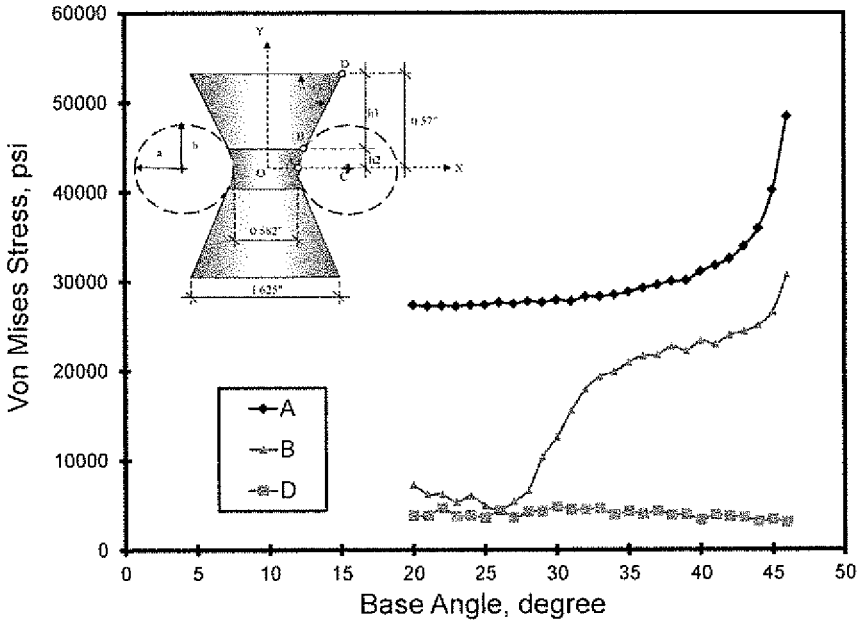
FIGS. 18(*a*)-18(*c*) illustrate the Von Mises stresses at the ends of the cone for different surfaces of revolution.
Figure 18B:
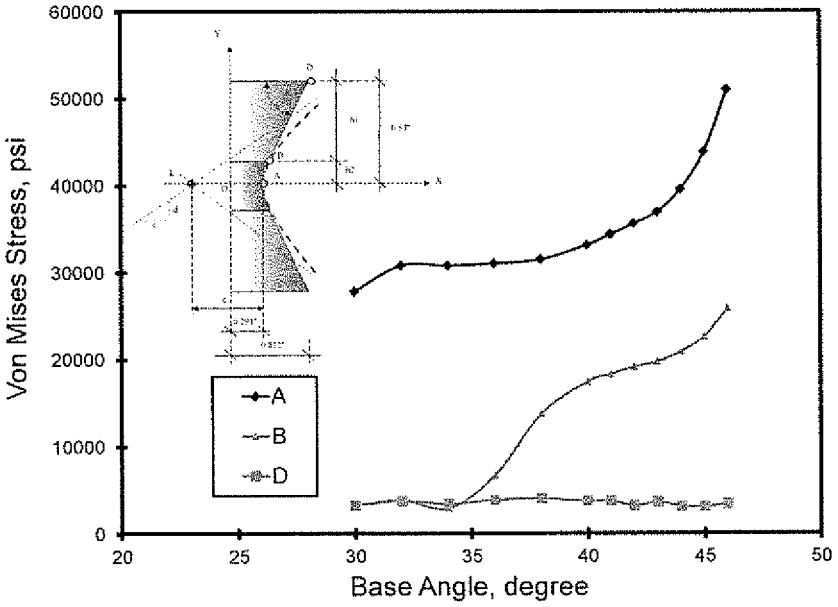
Figure 18C:
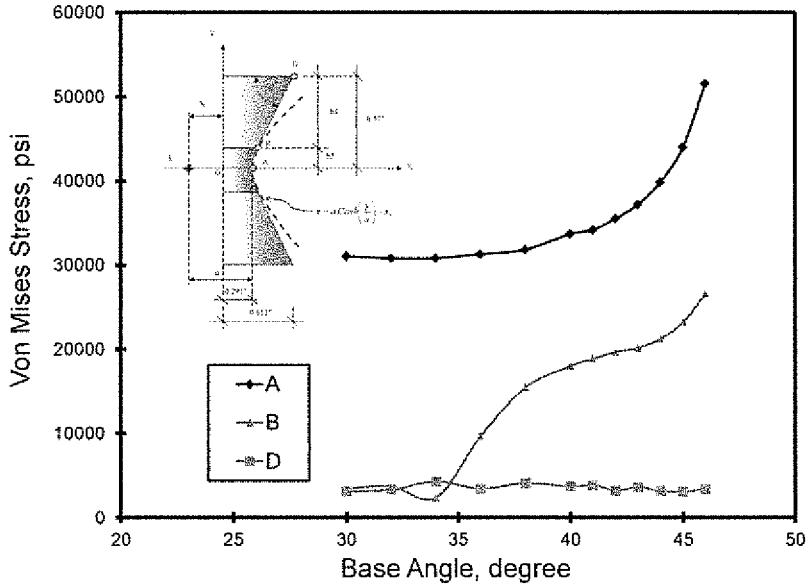

Von Mises stresses at the two ends of the surfaces of revolution (points A & B) and the cone (points B & D) are presented in FIGS. 18(*a*)-18(*c*). It is noted that Von Mises stress at point A increases exponentially with the increase in base angle θ while Von Mises stress at point D remains constant. However, Von Mises stresses at point B is obviously more complex and increases in high order polynomial fashion with respect to the increase in base angle θ. The complexity in the Von Mises stress profile is due to the simultaneous change in the location of the point, the cross sectional area of the respected plane, and the curvature of the surface. The trend for Von Mises stress is similar for all surfaces of revolution or substantially independent of the surface of revolution used.

Figure 19A:
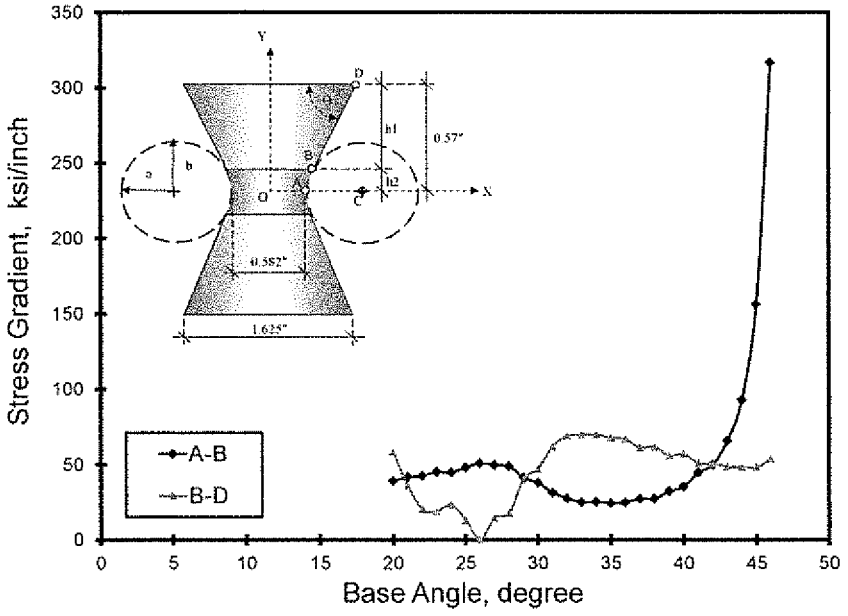
FIGS. 19(*a*)-19(*c*) illustrate the stress gradients at the transition zones within the cone for different surfaces of revolution.
Figure 19B:
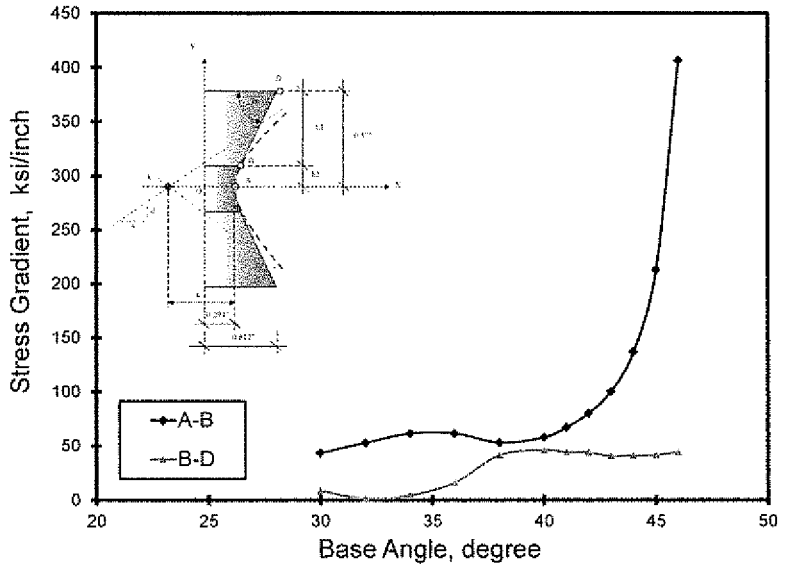
Figure 19C:
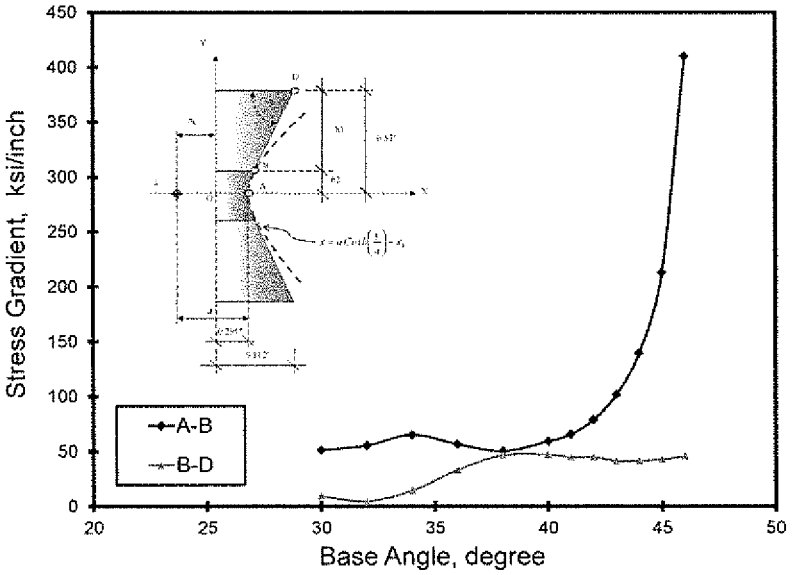

The stress gradients SG_AB and SG_BD are shown in FIGS. 19(*a*)-19(*c*). The figure also shows that above base angle 40°, SG_AB is very high and SG_BD is lower than its peak but still higher compared with much smaller angles such as 26° in the case of elliptic torus or 32° in the case of hyperboloid and catenoid. As the base angle decreases, SG_AB decreases significantly and SG_BD increases slightly. As both gradients govern fatigue behavior, it is obvious that current geometry with traditional high base angle θ=45° does not fall within an optimal design region/interval. Similar trends were observed for all surfaces of revolution.

Figure 20A:
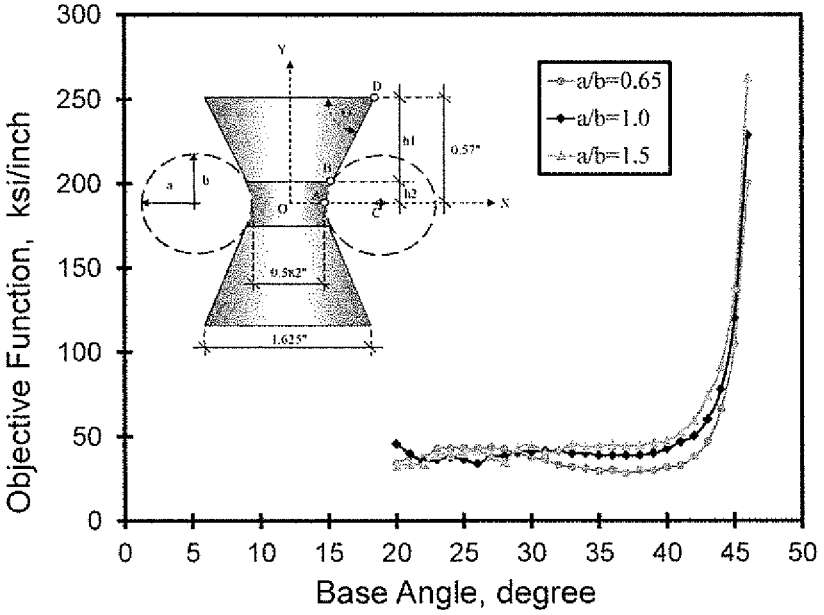
FIGS. 20(*a*)-20(*c*) illustrate the combined objective functions for different base angle values showing the significant drop in objective function values of the proposed design interval θ=[30°-37°] compared with current design θ=45° for different surfaces of revolution.
Figure 20B:
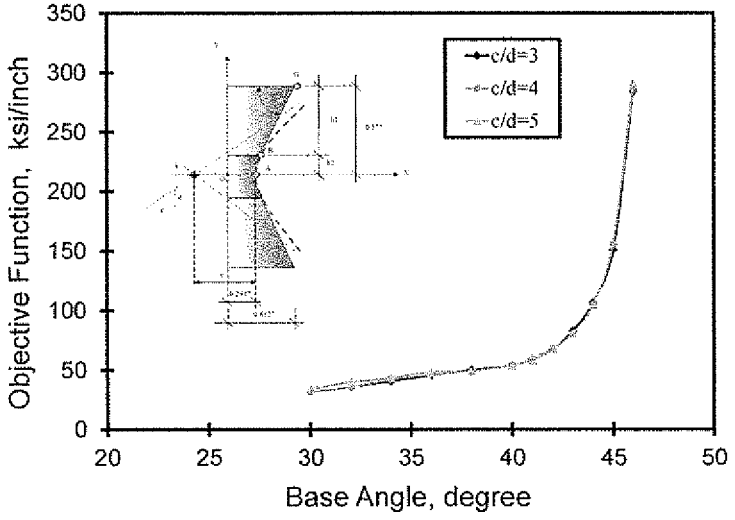
Figure 20C:
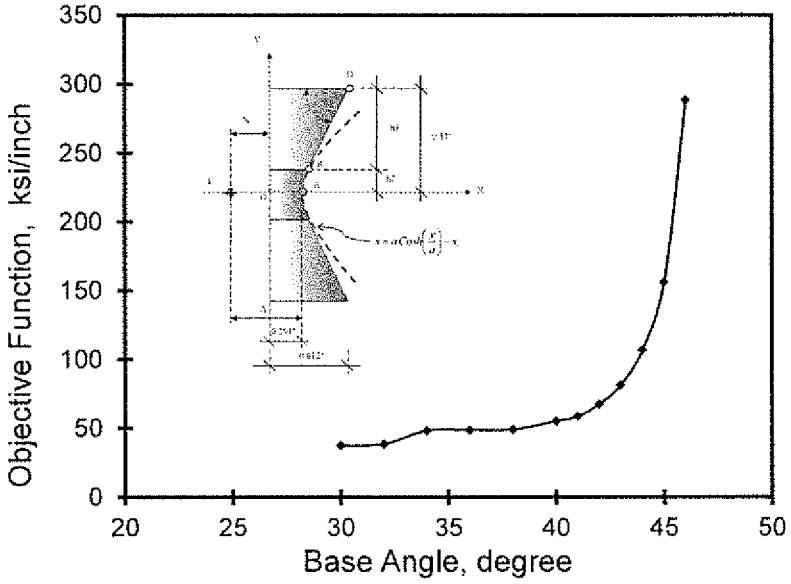

There exists two objectives: reducing the two stress gradients A-B and B-D. It is obvious from FIGS. 19(*a*)-19(*c*), that these objectives are not necessarily antagonistic. One technique to handle this case is to combine both objectives in a single objective function based on Eqn. 20. The combined objective function is calculated and plotted as a function of the base angle θ as for all geometrical cases shown in FIGS. 20(*a*)-20(*c*). Two regions for the combined objective function can be identified in FIG. 20. The first region is for large base angles (θ>40°) where the current design (θ=45°) exists. In this region, the combined objective function is very high and the design is therefore not a suitable one. The second region falls for small base angles (θ<40°). In this region, the combined objective function decreases significantly and approaches steady state or constant value between θ=30° and θ=37°. The objective function of the current design is 120 ksi/inch, approximately three times the steady-state value (~40 ksi/inch). This is because the base angle θ for the current or traditional design is relatively large (>40°) compared with the preferred design region θ=[30"-37°] in accordance with the invention. It is also important to note that the objective function is insensitive to the type of surface or revolution used in the optimization. In other words, all surfaces of revolution share similar trend for the objective function and very close stress gradient values.

The effect of unequal base angles on the stress gradients and objective functions is evident in Table (9). The table shows two objective functions for each case, one objective function for each half of the necking region. It is important to consider the maximum objective function for each case since it represents the critical stress gradient upon which the fatigue failure occurs. In this context, the table shows that the highest maximum objective function of 203 ksi/inch belongs to case 1 ($\theta_1=\theta_2=45°$ while the lowest maximum object function of 44 ksi/inch belongs to case 6 ($\theta_1=\theta_2=32°$). The cases 2 to 5 vary in their maximum objective function between case 1 and case 6. For instance, case 3 ($\theta_1=45°$, $\theta_2=32°$ exhibits maximum objective function of 89 ksi/inch. It is evident from these results that in order to reduce the maximum objective function, the two base angles should lie within the optimal range (θ=30-37°). It is also evident that the two base angles do not have to be equal to achieve suitable or optimal performance as long as they both lie within the optimal range.

TABLE (9)

Objective function for necking region with unequal base angles.

| | Case 1 | Case 2 | Case 3 | Case 4 | Case 5 | Case 6 |
|---|---|---|---|---|---|---|
| First base angle $\theta_1$, degree | 45 | 45 | 45 | 42 | 42 | 32 |
| Second base angle $\theta_2$, degree | 45 | 42 | 32 | 42 | 32 | 32 |
| First objective function ($F_1$), ksi/inch | 146 | 110 | 89 | 60 | 52 | 41 |
| Second objective function ($F_1$), ksi/inch | 203 | 115 | 55 | 100 | 48 | 44 |
| Maximum objective function ($F_1$), ksi/inch | 203 | 115 | 89 | 100 | 52 | 44 |

The design process was performed using three types of surface of revolution (elliptic torus, hyperboloid, and catenoid) and a wide range of base angles. The representative surfaces of revolutions cover all possible surfaces given the coupler geometry. The base angle of the coupler denoted "θ" was defined as the independent design variable. The relationships with other geometrical dependent variables were developed. A set of constraints for acceptable design of the coupler was defined. A combined multi-objective function to reduce the stress gradients in the surface of revolution and the cone areas was defined. The effect of unequal base angles on the stress gradient was also investigated.

The design showed that the objective function is substantially insensitive to the type of surface of revolution. The optimization also showed that the objective function is sensitive to the base angle θ. A base angle range between 30 to 37° represents a good working range for minimizing the objective function and improving the fatigue strength of the coupler. Within this interval or range the stress gradients are less than ⅓ of stress gradients developed with the current (Existing) or alternative (ALT-1) design angle of θ=45°. In addition, it is evident that preferred fatigue performance can be obtained using unequal base angles as long as both angles are within the optimal range. The current designs, known as Existing or Alternative couplers, are obviously not a design that addresses and improves fatigue performance.

Breakaway couplers in accordance with the present invention include base angles and geometry within the range of 30°-37° (an angle of 32 degree might be considered). The new coupler design will have improved fatigue strength compared with Existing and Alternative (AL-1) couplers and have been referred to as "Enhanced-Fatigue" or "EF" Coupler. The "EF" coupler is designed to meet AASHTO requirements for highway couplers.

Test Results

Scope of Testing

The EF couplers were tested with the objective to evaluate the fatigue strength of the EF coupler and compare it with the Existing and Alternative couplers. Twenty couplers were tested under cyclic loading with different mean stress levels and different stress ranges and determining the number of cycles to failure. The equivalent Stress-Number of Cycles to failure (S-N) curves and report the types of fracture were observed. Moreover, two additional modified-optimized steel couplers were tested: EF-Mod-A and EF-Mod-B, shown in FIGS. 21(*f*)-(*i*).

Four couplers of each type were tested under cyclic loading then the fatigue life was compared with Existing, Alternative, and EF couplers.

Figure 21A:
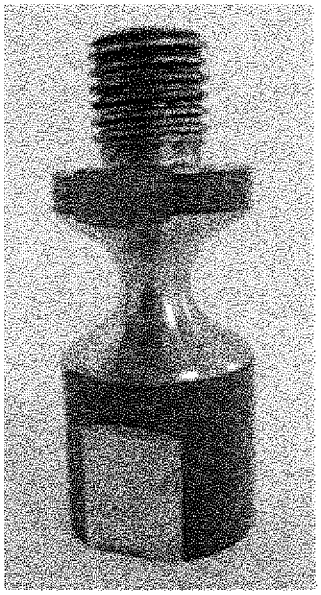
FIGS. 21(*a*)-21(*c*) are snapshots of (a) EF, (b) EF-Mod-A, and (c) EF-Mod-B couplers.
Figure 21B:
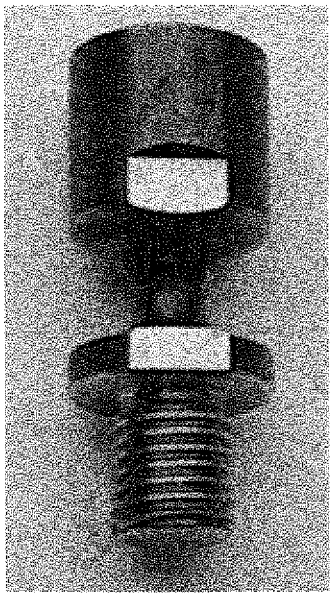
Figure 21C:
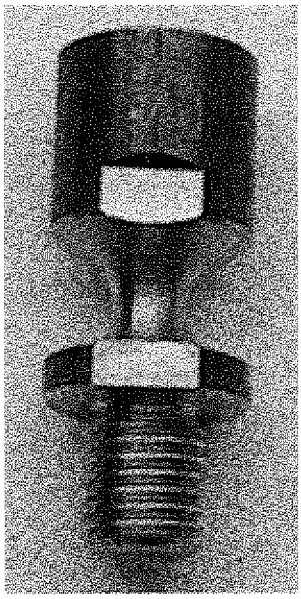

Referring to FIGS. 21(*d*) and 21(*e*) an enhanced fatigue or EF coupler in accordance with the present invention is shown which is provided with two full truncated cones at the two axial ends of the neck down region each having a base angle of 32°. Modified EF couplers, Mod-A and Mod-B are shown in FIGS. 21(*f*)-(*i*) which have dimensions of the neck down region reduced from those in the EF coupler shown in FIGS. 21(*d*)-(*e*). Thus, whereas the height of the neck down region for the EF coupler shown in FIGS. 21(*d*)-(*e*) is 1.145" and the minimum neck diameter is 0.582" the height of the neck down region for EF Mod-A is 0.975" and the minimum diameter is 0.57". While the base angle θ of the upper cone is still 32° the lower cone has been further truncated somewhat to shorten the height of the neck down region and, essentially, remove some of the volume of material in the neck. Similarly, in FIGS. 21(*h*)-(*i*) the aforementioned dimensions have been modified to provide a minimum neck diameter of 0.58" and a neck height of 0.985". The remaining dimensions of the externally and internally threaded ends or posts are the same for all of the couplers. The truncation of the lower cones for Mod-A and Mod-B were intended to change the amount of energy needed to sever the coupler upon impact. However, the upper cone base angles for all of these couplers in FIGS. 21(*d*)-(*i*) are all the same at 32°

Fatigue Tests Description

Figure 22:
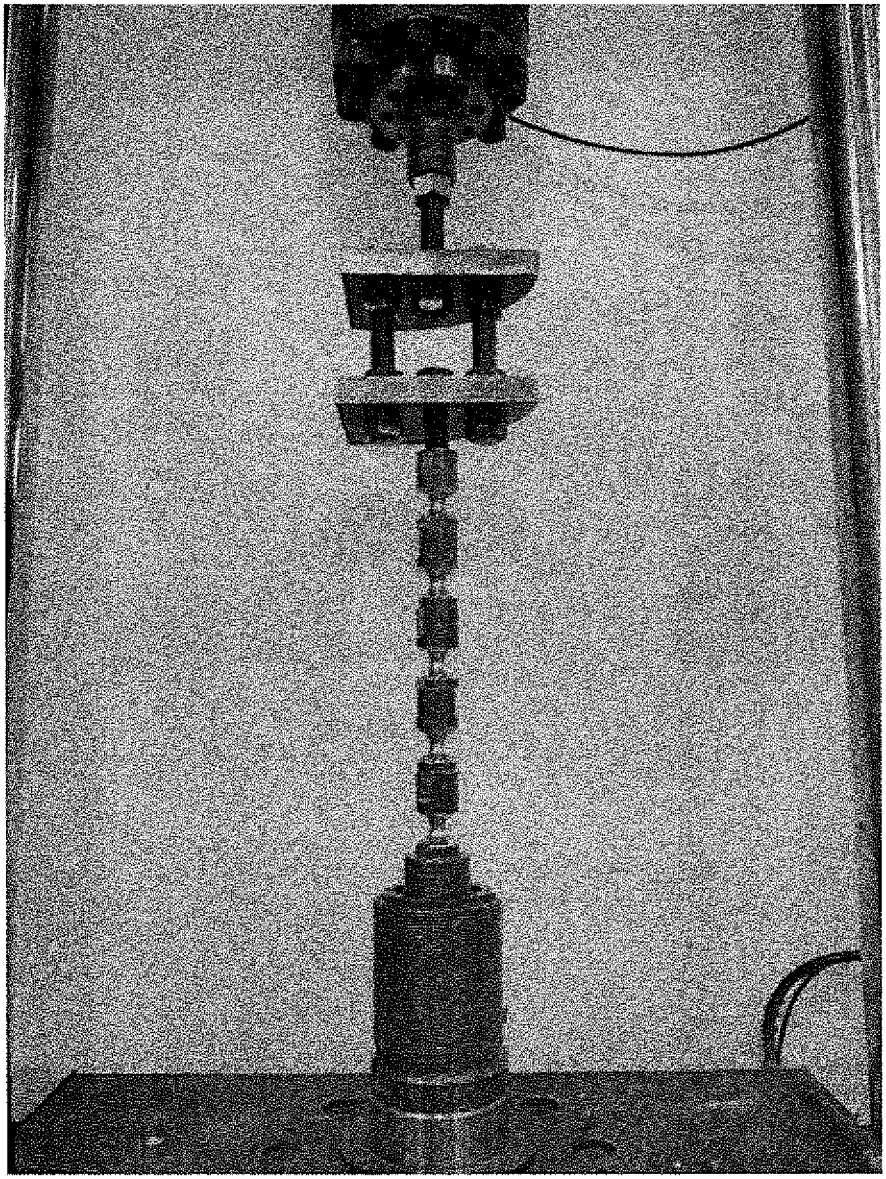
FIG. 22 is a snapshot of the fatigue test setup.

The purpose of the fatigue test is to determine the number of cycles to failure and develop equivalent Stress-Number of Cycles to failure (S-N) curves to allow comparison of the fatigue behavior of the three types of galvanized steel couplers. The word "equivalent" here is used to describe the S-N curves as establishing the "true" S-N curves for the couplers requires testing very high number of specimens (>30 specimens). The "EF" coupler is examined under cyclic loading. The modified-EF, EF-Mod-A, and EF-Mod-B couplers are shown in FIGS. 21(*a*)-21(*c*). The fatigue test was performed with an Instron® loading frame connected to MTS® 793 Flex DAQ. The test was conducted on series of maximum 5 couplers at a time connected by the male and female threads to form a chain as in FIG. 22. The chain is connected to the bottom platen with threaded rod and to the top cross head with plate bending frame. The frame is designed to avoid producing bending moments on the couplers.

Tension Fatigue Tests

Four test protocols were performed on a total of 25 specimens of EF couplers. Each test protocol was cyclic load controlled with a frequency of 1 Hz. The mean tension loads and stresses vary in the four test protocols as follows:

| | |
|---|---|
| Test protocol-1 | mean tension load of 4.85 kip, amplitude of 3.03 kip mean stress of 17.98 ksi, 51.59% of max stress test |
| Test protocol-2 | mean tension load of 6.37 kip, amplitude of 4.55 kip mean stress of 23.60 ksi, 67.72% of max stress test |
| Test protocol-3 | mean tension load of 7.88 kip, amplitude of 6.06 kip mean stress of 29.22 ksi. 83.85% of max stress test |
| Test protocol-4 | mean tension load of 9.40 kip, amplitude of 7.58 kip mean stress of 34.85 ksi, 100% of max stress test |

Furthermore, 8 specimens of the modified-EF couplers, EF-Mod-A and EF-Mod-B, were tested under Test protocol-4.

Figure 23:
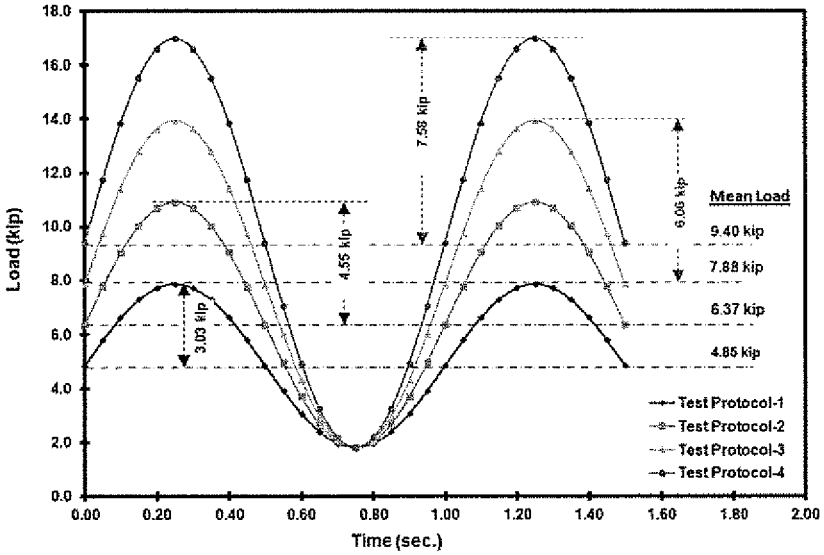
FIG. 23 illustrates the fatigue testing protocols, showing the mean and amplitude of the fatigue load cycles for test protocols 1-4 used to evaluate tested couplers.
Figure 24:
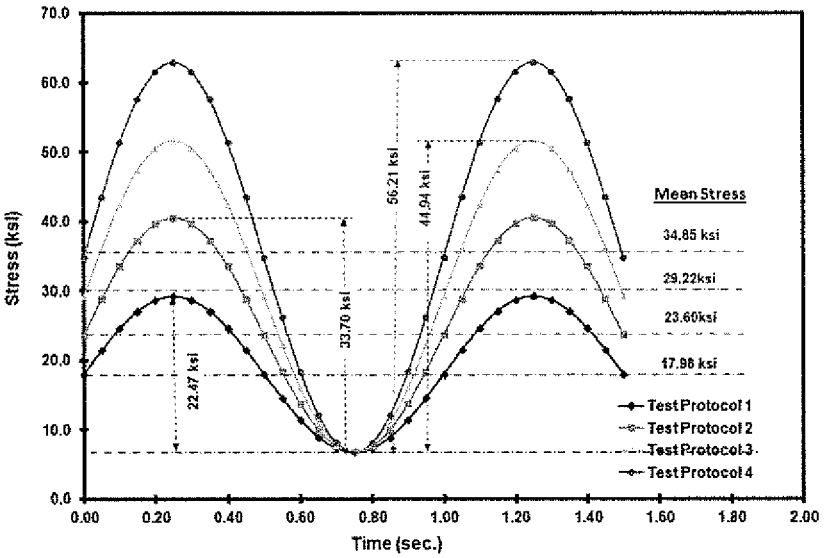
FIG. 24 illustrates the fatigue testing protocols, showing the mean and amplitude of the equivalent fatigue stress cycles for test protocols 1-4 used to evaluate tested couplers.
Figure 25:
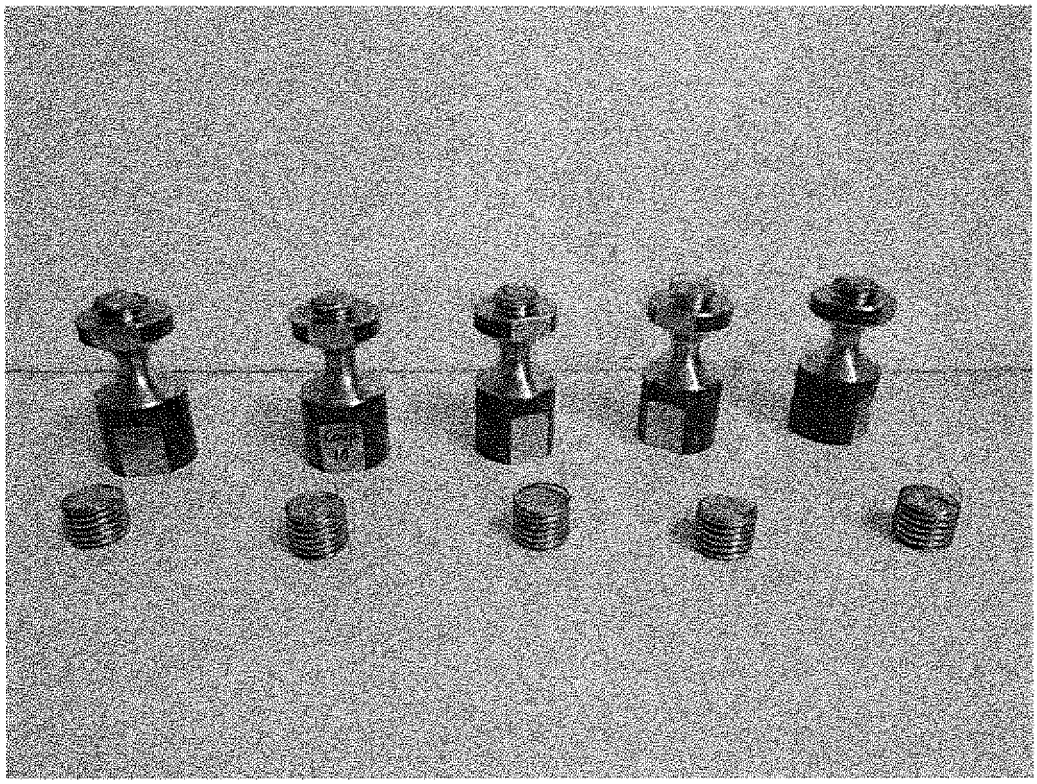
FIG. 25 is a snapshot of five fractured EF couplers tested in Test Protocol-4.
Figure 26:
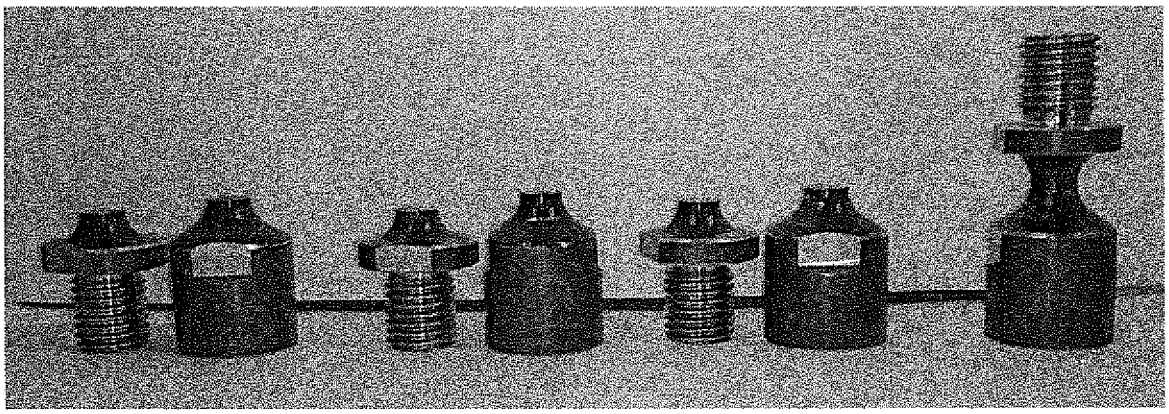
FIG. 26 is a snapshot of EF Mod-A couplers tested in Test Protocol-4.
Figure 27:
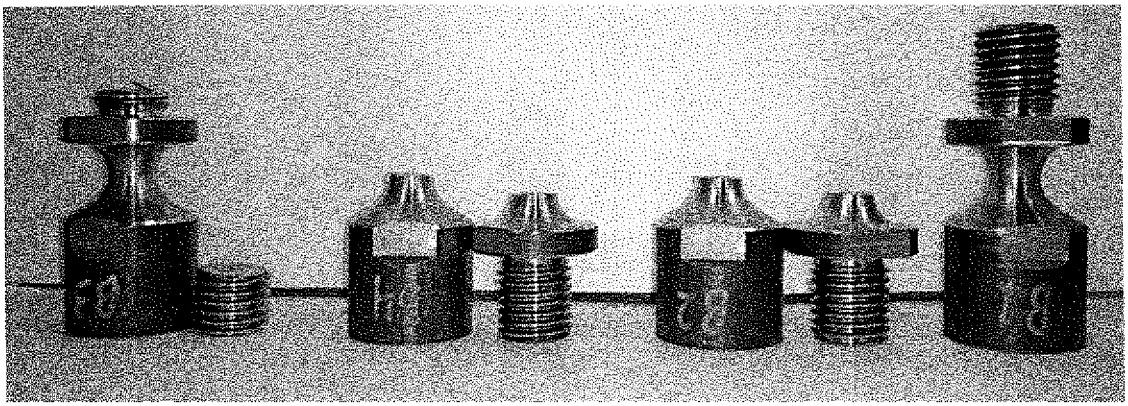
FIG. 27 is a snapshot of EF Mod-B couplers tested in Test Protocol-4.
Figure 28:
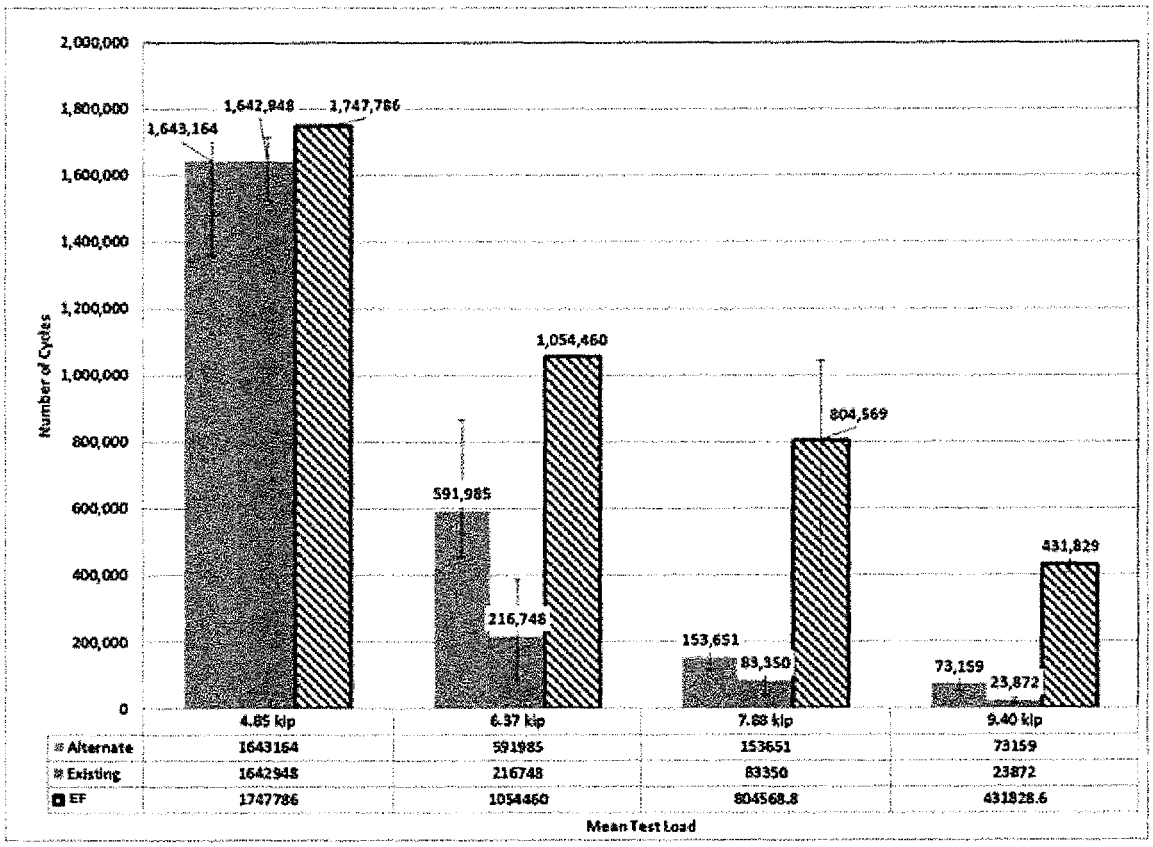
FIG. 28 is a chart comparing the fatigue performance of the three couplers (Existing, Alternative and EF)
Figure 29:
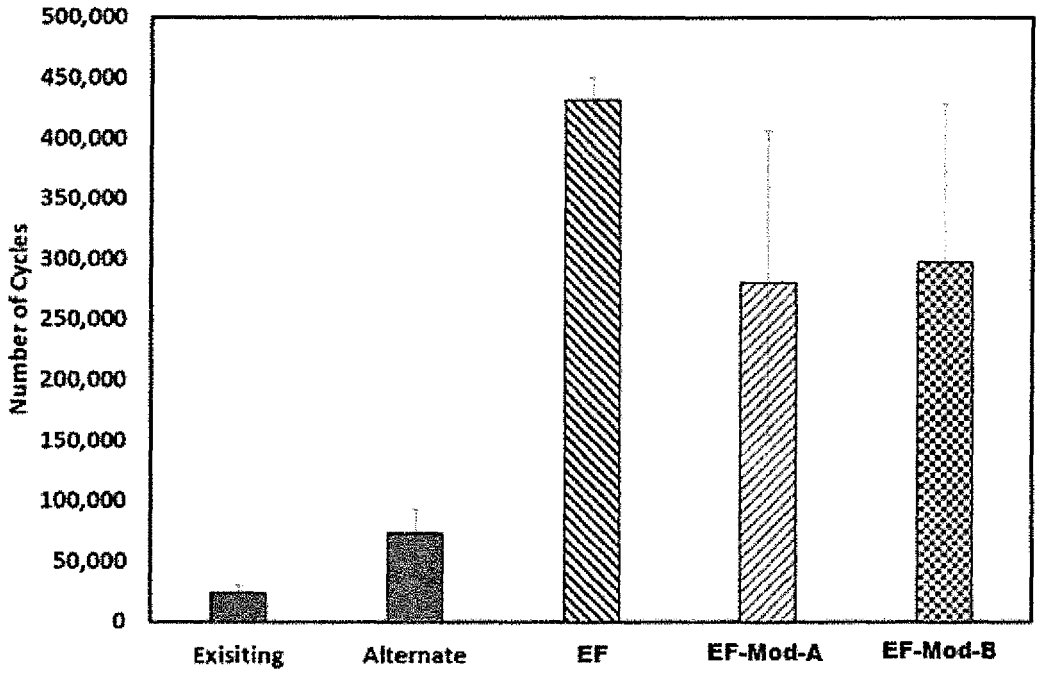
FIG. 29 is a chart comparing the fatigue performance of the five couplers under testing protocol-4 including the two EF Mod-A and Mod-B couplers.
Figure 30:
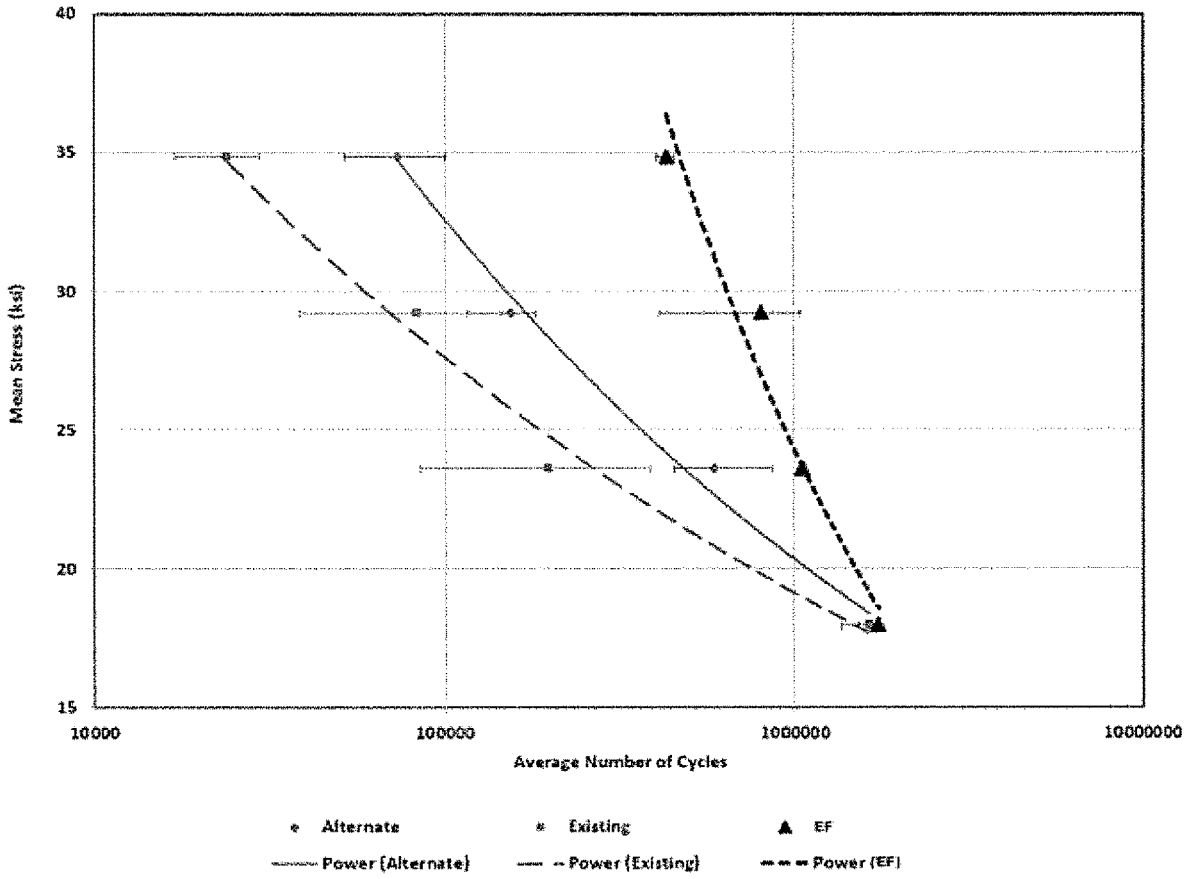
FIG. 30 illustrates the Mean Stress Equivalent S-N curve for the EF, Existing, and Alternative couplers.
Figure 31:
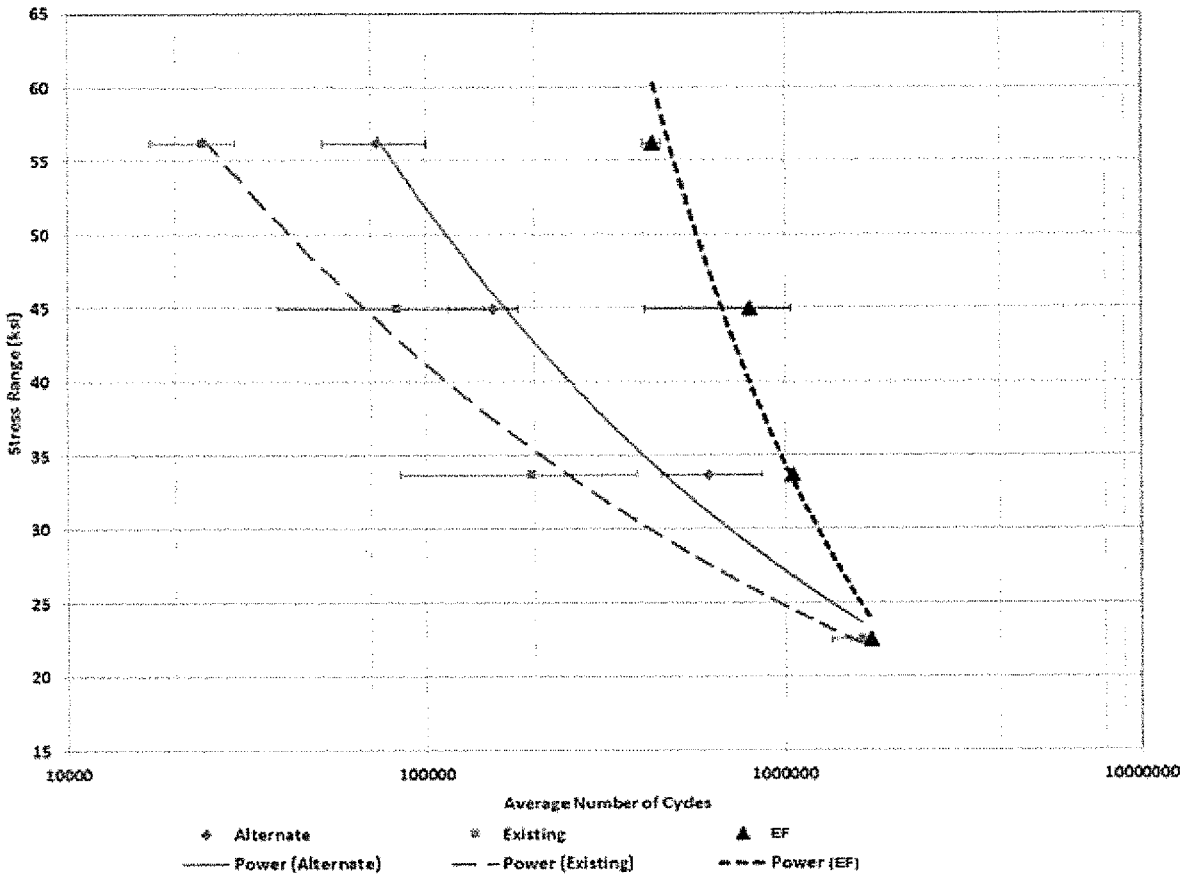
FIG. 31 illustrates the Stress Range Equivalent S-N curve for the EF, Existing, and Alternative couplers.
Figure 32:
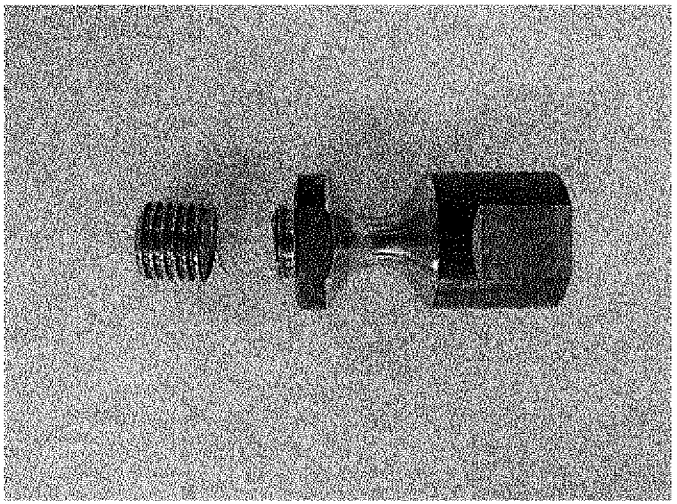
FIG. 32 is a snapshot of an EF 6 Failure at 430,150 cycles (mean load=9.40 kip; mean stress=34.85 ksi)
Figure 33:
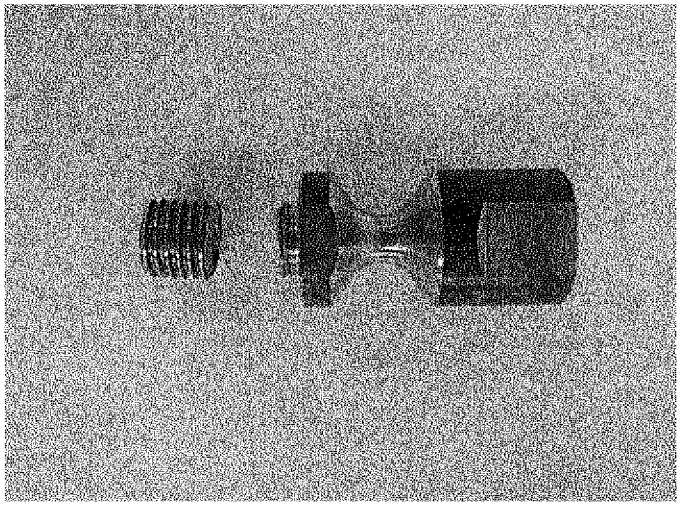
FIG. 33 is a snapshot of an EF 7 Failure at 439,150 cycles (mean load=9.40 kip; mean stress=34.85 ksi)
Figure 34:
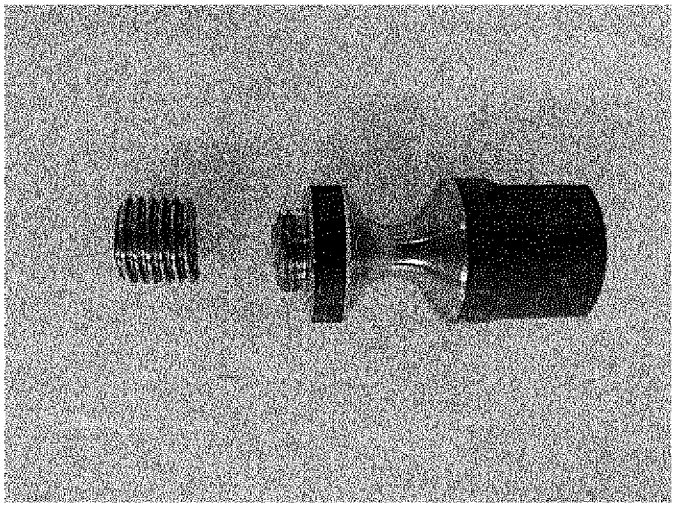
FIG. 34 is a snapshot of an EF 9 Failure at 440,114 cycles (mean load=9.40 kip; mean stress=34.85 ksi)
Figure 35:
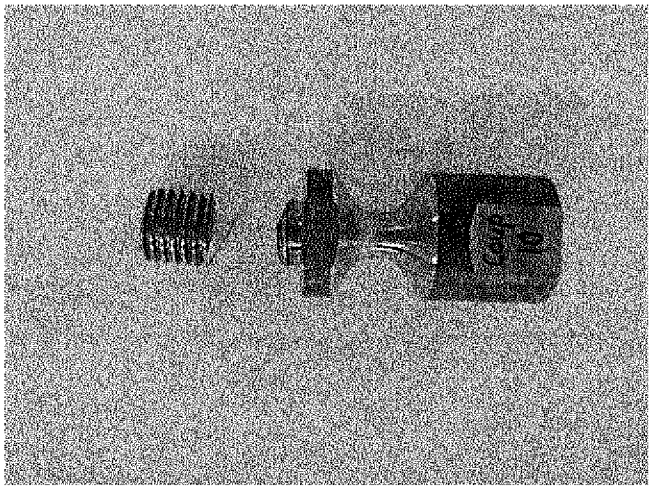
FIG. 35 is a snapshot of an EF 10 Failure at 404,763 cycles (mean load=9A0 kip; mean stress=34.85 ksi)
Figure 36:
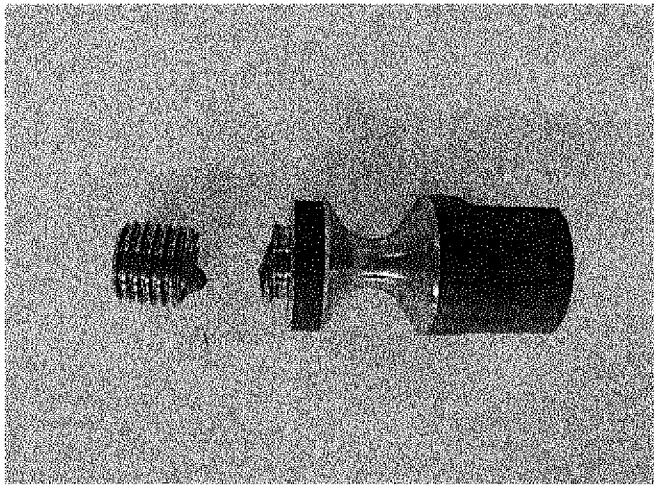
FIG. 36 is a snapshot of an EF 15 Failure at 453,966 cycles (mean load=9A0 kip; mean stress=34.85 ksi)
Figure 37:
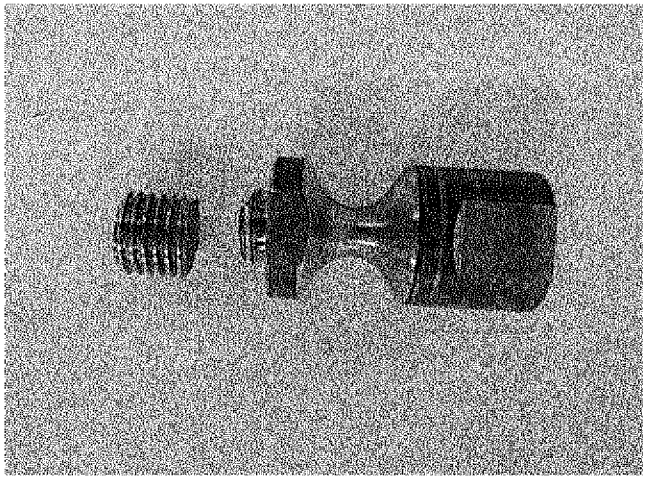
FIG. 37 is a snapshot of an EF 21 Failure at 861,697 cycles (mean load=7.88 kip; mean stress=29.22 ksi)
Figure 38:
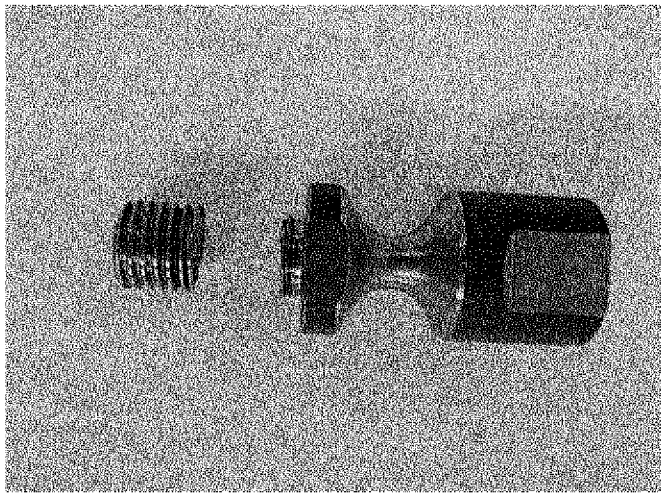
FIG. 38 is a snapshot of an EF 24 Failure at 411,064 cycles (mean load=7.88 kip; mean stress=29.22 ksi)
Figure 39:
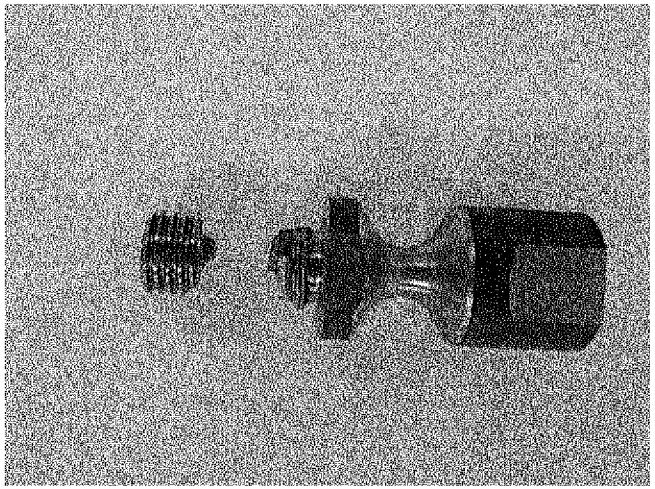
FIG. 39 is a snapshot of an EF 25 Failure at 666,331 cycles (mean load=7.88 kip; mean stress=29.22 ksi).

The couplers were kept under tension-tension fatigue cycles during all test protocols 1 through 4. All stress values reported represent the average stress over the area of the smallest diameter of the coupler as shown in FIG. 23. It is important to note that the smallest diameter of the couplers were kept the same for all couplers compared here (Existing, Alternative and EF). The mean loads and load amplitudes for each test protocol are shown in FIG. 24. The equivalent fatigue stress cycles for the four protocols is shown in FIG. 25. If failure did not happen, the test was stopped at 1.7 million cycles for test protocol-1 and at 1 million cycles for all other test protocols. All modified-optimized couplers were tested under Test protocol-4 only.

Fatigue Test Results

Figure 5A:
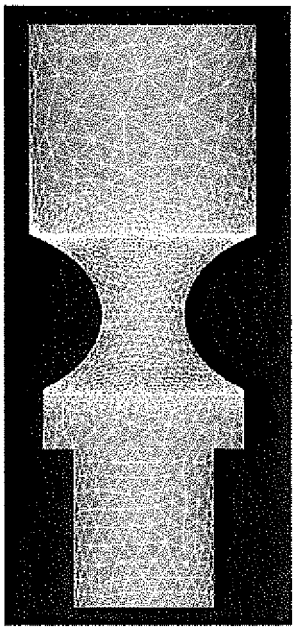
FIGS. 5(*a*)-5(*c*) are snapshots of finite element models of double cone couplers with an elliptic torus (a/b=1.5) surface of revolution and three different base angles.
Figure 5B:
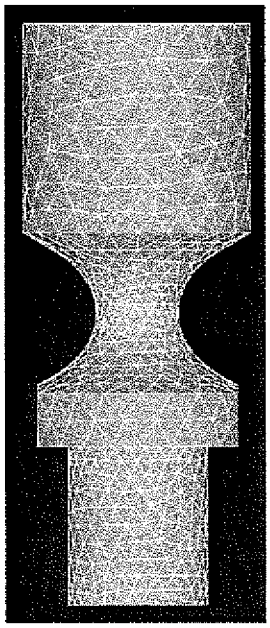
Figure 5C:
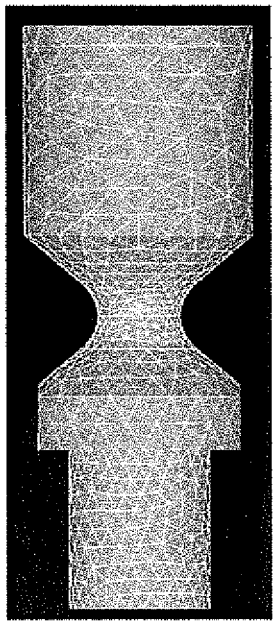

All couplers tested under test protocol-1 and test protocol-2 did not fail. All the couplers failed in test protocol-3 and test protocol-4 fractured at the threads section and not at the coupler's neck. This indicates that the coupler's neck does not govern fatigue of the couplers any further. This proves the significantly different performance of the EF couplers compared with Existing and Alternative couplers where neck failure was dominant in fatigue. FIG. 5 shows photos of the five fractured couplers under maximum fatigue stress (Test Protocol-4). For modified-EF couplers, EF-Mod-A and EF-Mod-B, four couplers of each type were only tested under test protocol-4. FIG. 6 and FIG. 7 show tested EF-Mod-A and EF-Mod-B couplers.

The object of the design effort was to experimentally compare the fatigue strength/life of EF couplers with both Existing and Alternative couplers. Twenty EF Transpo couplers were tested under 4 testing protocols to identify the fatigue strength of the couplers. These protocols included varying mean stress values.

All the tests showed that the fatigue strength of the EF Transpo coupler is higher (twice to six times) than that of the Alternative couplers under tension fatigue loads. All tested couplers did not fail under mean stresses of 17.98 ksi and achieved endurance limit of 1.7 million cycles. Fracture surfaces of EF couplers were recorded and no failure took place at the coupler's neck. Failures in the outer thread were observed at much high fatigue strength compared with Existing or Alternative Couples. It is evident that the EF coupler has superior fatigue strength compared with Existing and Alternative Transpo couplers.

Furthermore, it is also evident that the modified-EF couplers, (Mod-A) and (Mod-B), have superior fatigue performance that is one order of magnitude higher in fatigue life than Existing couplers and about 4 times higher in fatigue life compared with Alternative couplers. Some of the modified-EF couplers did not fail under the test protocol #4 used. The modified-EF couplers showed a fatigue life about 75% of that of the EF couplers. Nevertheless, the fatigue life shown by the modified-EF is superior for all intended applications and is an order of magnitude higher than Existing couplers used today in field applications.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What claimed is:

1. In a fatigue-resistant break-away coupling formed of metal and having a central axis and a necked-down central region formed by two inverted truncated cones each having larger and smaller bases joined at the smaller bases by a narrowed transition region having an exterior surface formed by a curved surface of revolution having an inflection point of minimum diameter substantially midway of the coupling along said axis, said cones each defining an angle $\theta_1$, and $\theta_2$, respectively at each of said larger bases, wherein both $\theta_1$, and $\theta_2$ are selected to be within the range of 20°-42°.

2. In a break-away couplings as set forth in claim 1, wherein $\theta_1$, and $\theta_2$ are equal.

3. In a break-away couplings as set forth in claim 1, wherein $\theta_1$, and $\theta_2$ are not equal.

4. In a break-away couplings as set forth in claim 1, wherein $\theta_1$ is equal to approximately 32°.

5. In a break-away couplings as set forth in claim 1, wherein $\theta_2$ is equal to approximately 32°.

6. In a break-away couplings as set forth in claim 1, wherein said curved surface of revolution is defined by an elliptic torus.

7. In a break-away couplings as set forth in claim 1, wherein said curved surface of revolution is defined by a hyperboloid.

8. In a break-away couplings as set forth in claim 1, wherein said curved surface of revolution is defined by a catenoid.

9. In a break-away couplings as set forth in claim 1, wherein both $\theta_1$, and $\theta_2$ are within the range of 30°-37°.

10. In a break-away couplings as set forth in claim 1, wherein said larger bases have diameters of approximately 1.625".

11. In a break-away couplings as set forth in claim 1, wherein said narrowed transition region forms a necking region having a diameter of approximately 0.582".

12. In a break-away couplings as set forth in claim 1, wherein said narrowed transition region forms a necking region having a height or depth along said axis of approximately 0.572".

13. In a break-away couplings as set forth in claim 1, wherein said narrowed transition region forms a necking region having a minimum diameter of approximately 0.582" and a height or depth along said axis approximately equal to 0.572".

14. A method of forming a fatigue resistant break-away coupling formed of metal and having a central axis and a necked-down central region comprising the steps of forming two inverted truncated cones each having larger and smaller bases, said cones each defining an angle $\theta_1$, and $\theta_2$ respectively, at each of said larger bases; joining said cones at said smaller bases by a narrowed transition region having an exterior surface formed by a curved surface of revolution having an inflection point of minimum diameter; and selecting $\theta_1$ and $\theta_2$ to be within the range of 20°-42°.

15. A method as set forth in claim 14, wherein $\theta_1$, and $\theta_2$ are selected to be equal.

16. A method as set forth in claim 14, wherein $\theta_1$, and $\theta_2$ are selected not to be equal.

17. A method as set forth in claim 14, wherein $\theta_1$, and $\theta_2$ are selected to be within the range of 30°-37°.

18. A method as set forth in claim 14, wherein $\theta_1$ is selected to be approximately 32°.

19. A method as set forth in claim 14, wherein $\theta_2$ is selected to be approximately 32°.

20. In a roadside appurtenance comprising a post or other load; a plurality of fatigue resistant break-away couplings supporting said post or other load, wherein each fatigue, resistant break-away coupling is formed of metal and has a central axis and a necked-down central region formed by two inverted truncated cones each having larger and smaller bases joined at the smaller bases by a narrowed transition region having an exterior surface formed by a curved surface of revolution having an inflection point of minimum diameter, said cones defining an angle defining an angle $\theta_1$ and $\theta_2$, respectively, at each of said larger bases, wherein $\theta_1$ and $\theta_2$ are selected to be within the range of 20°-42°.

* * * * *